US007561828B2

(12) United States Patent
Nukada et al.

(10) Patent No.: US 7,561,828 B2
(45) **Date of Patent: *Jul. 14, 2009**

(54) IMAGE-FORMING APPARATUS INCLUDING AN ELECTROPHOTOGRAPHIC PHOTORECEPTOR HAVING AN UNDERCOAT LAYER

(75) Inventors: Hidemi Nukada, Minamiashigara (JP); Hirofumi Nakamura, Minamiashigara (JP); Taketoshi Hoshizaki, Minamiashigara (JP); Yu Qi, Oakville (CA); Ah-Mee Hor, Mississauga (CA); Nan-Xing Hu, Oakville (CA)

(73) Assignees: Fuji Xerox Co., Ltd., Tokyo (JP); Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/081,651

(22) Filed: Mar. 17, 2005

(65) Prior Publication Data

US 2006/0013615 A1 Jan. 19, 2006

(30) Foreign Application Priority Data

Jul. 16, 2004 (JP) ..... 2004-210748

(51) Int. Cl.
*G03G 15/00* (2006.01)
*G03G 15/04* (2006.01)

(52) U.S. Cl. ..... 399/159; 399/167; 430/60; 430/65

(58) Field of Classification Search ..... 399/167, 399/159; 430/60, 65
See application file for complete search history.

(56) References Cited

U.S. PATENT DOCUMENTS

| | | | |
|---|---|---|---|
| 4,264,695 | A | 4/1981 | Kozima et al. |
| 4,265,990 | A | 5/1981 | Stolka et al. |
| 4,298,697 | A | 11/1981 | Baczek et al. |
| 4,338,390 | A | 7/1982 | Lu |
| 4,560,635 | A | 12/1985 | Hoffend et al. |
| 4,778,671 | A | 10/1988 | Wusirika |

(Continued)

FOREIGN PATENT DOCUMENTS

| | | |
|---|---|---|
| CN | 1105128 | 8/1997 |

(Continued)

OTHER PUBLICATIONS

Varcum 29159 Data Sheet, Durez Corp. (Jul. 13, 2005).

(Continued)

*Primary Examiner*—David M Gray
*Assistant Examiner*—Laura K Roth
(74) *Attorney, Agent, or Firm*—Oliff & Berridge, PLC

(57) ABSTRACT

The invention provides an image-forming apparatus, having an electrophotographic photoreceptor, a charging unit, a light-exposure unit, a development unit, a transfer unit, and a controller that controls the traveling speed of the peripheral surface of the electrophotographic photoreceptor and that thus makes a period from charging to development variable, wherein: the electrophotographic photoreceptor has an undercoat layer and a photosensitive layer; and the undercoat layer contains metal oxide fine particles with an acceptor compound added thereto; and an image is formed by charging, light exposure, development and transfer while causing the peripheral surface of the electrophotographic photoreceptor to travel in a predetermined direction; and a process cartridge that is detachable from the image forming apparatus.

22 Claims, 3 Drawing Sheets

U.S. PATENT DOCUMENTS

| | | | | |
|---|---|---|---|---|
| 4,792,507 | A | | 12/1988 | Yoshihara et al. |
| 5,008,706 | A | | 4/1991 | Ohmori et al. |
| 5,102,757 | A | | 4/1992 | Akasaki et al. |
| 5,363,176 | A | | 11/1994 | Ishihara et al. |
| 5,430,526 | A | | 7/1995 | Ohkubo et al. |
| 5,446,011 | A | | 8/1995 | Hayakawa et al. |
| 5,486,440 | A | | 1/1996 | Kashizaki et al. |
| 5,795,690 | A | * | 8/1998 | Takegawa et al. ..... 430/62 |
| 5,891,594 | A | | 4/1999 | Yuh et al. |
| 5,958,638 | A | | 9/1999 | Katayama et al. |
| 5,965,311 | A | | 10/1999 | Suzuki |
| 5,972,550 | A | | 10/1999 | Tamura et al. |
| 6,137,976 | A | * | 10/2000 | Itaya et al. |
| 6,183,869 | B1 | | 2/2001 | Okuda et al. |
| 6,190,811 | B1 | | 2/2001 | Tanaka et al. |
| 6,277,535 | B1 | | 8/2001 | Liu et al. |
| 6,284,421 | B1 | | 9/2001 | Matsuzaki et al. |
| 6,453,139 | B2 | | 9/2002 | Sasame et al. |
| 6,455,222 | B1 | | 9/2002 | Fukino et al. |
| 6,623,655 | B1 | | 9/2003 | Kappel et al. |
| 6,773,857 | B2 | | 8/2004 | Nakamura et al. |
| 6,795,690 | B2 | | 9/2004 | Weissman et al. |
| 6,921,618 | B2 | | 7/2005 | Hongo et al. |
| 6,924,076 | B2 | | 8/2005 | Saiki et al. |
| 6,946,226 | B2 | | 9/2005 | Wu et al. |
| 7,153,574 | B2 | | 12/2006 | Qi et al. |
| 2002/0025179 | A1 | * | 2/2002 | Toyohara et al. |
| 2003/0118927 | A1 | * | 6/2003 | Nakamura et al. ..... 399/159 |
| 2004/0161684 | A1 | | 8/2004 | Wu et al. |
| 2005/0042533 | A1 | | 2/2005 | Wu et al. |
| 2005/0207788 | A1 | * | 9/2005 | Bandou et al. ..... 399/159 |
| 2006/0013615 | A1 | | 1/2006 | Nukada et al. |
| 2006/0013616 | A1 | | 1/2006 | Nukada et al. |
| 2006/0014090 | A1 | | 1/2006 | Shiino et al. |
| 2006/0014091 | A1 | | 1/2006 | Nukada et al. |
| 2006/0014092 | A1 | * | 1/2006 | Nukada et al. |
| 2006/0029872 | A1 | | 2/2006 | Qi et al. |

FOREIGN PATENT DOCUMENTS

| | | | | |
|---|---|---|---|---|
| CN | 1403879 | A | | 3/2003 |
| EP | A-810481 | | | 12/1997 |
| EP | 1286225 | | | 11/2005 |
| JP | A 60-218655 | | | 11/1985 |
| JP | A 61-80158 | | | 4/1986 |
| JP | B2 61-35551 | | | 8/1986 |
| JP | A 61-204640 | | | 9/1986 |
| JP | A-63-142362 | | | 6/1988 |
| JP | A-7-175249 | | | 7/1995 |
| JP | A-8-044097 | | | 2/1996 |
| JP | A-09-197701 | | | 7/1997 |
| JP | A-9-218592 | | | 8/1997 |
| JP | A 2003-241511 | | | 8/2003 |
| JP | A-2003-241511 | | | 8/2003 |
| JP | 2004126069 | A | * | 4/2004 |
| JP | A-2004-126069 | | | 4/2004 |

OTHER PUBLICATIONS

Grant & Hackh's Chemical Dictionary, Fifth edition, p. 268, 1987.

* cited by examiner

IMAGE-FORMING APPARATUS INCLUDING AN ELECTROPHOTOGRAPHIC PHOTORECEPTOR HAVING AN UNDERCOAT LAYER

CROSS-REFERENCE TO RELATED APPLICATION

This application claims priority under 35 U.S.C. 119 from Japanese Patent Application No. 2004-210748, the disclosure of which is incorporated by reference herein.

BACKGROUND OF THE INVENTION

1. Field of the Invention

The present invention relates to an image-forming apparatus and a process cartridge.

2. Description of the Related Art

Since electrophotographic processes allow high-speed and high-quality printing, they have been used in various electrophotographic systems such as copying machines and laser beam printers.

Recent mainstream photoreceptors used in electrophotographic systems are made of an organic photoconductive material. In terms of the structure of the photoreceptor, single-layer photoreceptors are gradually replaced with layered photoreceptors wherein a charge generating material and a charge transport material are dispersed in separate layers (charge generating and charge transport layers).

In addition, the recent trend toward improvement in the quality and speed of business processing in offices has boosted the need for faster and full-color processing of documents, which in turn has brought about improvement in the speed, quality and multi-color compatibility of image-forming apparatuss such as copying machines, printers, and facsimiles that process these documents. In response to this demand, for example, various kinds of so-called tandem color image-forming apparatuss have been developed and commercialized that have plural image-forming units respectively responsible for each of color images of black (K), yellow (Y), magenta (M), and cyan (C), and that transfer the images differing in color formed in the respective image-forming units in a superimposed manner and thus form color images on an image-receiving medium or an intermediate transfer member.

For improvement both in quality and efficiency of these color image-forming apparatuss, methods of switching image-forming modes according to the kind of image and image-receiving medium have been investigated [e.g., Japanese Patent Application Laid-Open (JP-A) No. 2003-241511]. For example, when a monochromic image is formed, the image can only be formed using a black toner, and therefore processing is likely carried out at a processing speed higher than that when forming color images. In addition, regardless of whether the image-forming apparatus is a color or monochrome machine, if the image-receiving medium is cardboard, an overhead projector (OHP) sheet or other similar medium, it is considered possible to obtain high-quality images by extending the image-forming period such that it is longer than that for usual processing.

However, an apparatus that operates under plural processing conditions (modes) that differ in the length of the period from charging to development often fails to provide images of sufficiently high quality. In other words, switching of image-forming modes inevitably leads to changes in the length of the period from charging to development, and electrophotographic photoreceptors that are compatible with such changes in usage conditions have not yet been investigated sufficiently. For example, processing conditions that elongate the period from charging to development often leads to problems of more frequent generation of image memory (images undesirably remaining on the photoreceptor after a step of eliminating charges on the photoreceptor) and images carrying a higher degree of fogging and more black spots.

Accordingly, there exists a need for an image-forming apparatus or a process cartridge that suppresses generation of fogging and black spots on output images and generation of image memory, even when the apparatus or the cartridge operates under plural processing conditions that differ in the length of the period from charging to development.

SUMMARY OF THE INVENTION

A first aspect of the present invention provides an image-forming apparatus, having an electrophotographic photoreceptor, a charging unit, a light-exposure unit, a development unit, a transfer unit, and a controller that controls the traveling speed of the peripheral surface of the electrophotographic photoreceptor and thus makes a period from charging to development variable, wherein: the electrophotographic photoreceptor has an undercoat layer and a photosensitive layer, and the undercoat layer contains metal oxide fine particles with an acceptor compound added thereto; and an image is formed by charging, light exposure, development and transfer while causing the peripheral surface of the electrophotographic photoreceptor to travel in a predetermined direction.

A second aspect of the invention provides a color image-forming apparatus, including a plurality of image forming units each having an electrophotographic photoreceptor, a charging unit, a light-exposure unit, and a development unit, a transfer unit, and a controller that controls the traveling speed of the peripheral surface of each of the electrophotographic photoreceptors and thus makes a period from charging to development variable, wherein: the electrophotographic photoreceptor has an undercoat layer and a photosensitive layer, and the undercoat layer contains metal oxide fine particles with an acceptor compound added thereto; and an image is formed by charging, light exposure, development and transfer while causing the peripheral surface of each of the electrophotographic photoreceptors to travel in a predetermined direction.

In the image-forming apparatus according to the invention, even when the period from charging to development is elongated, it becomes possible to improve the electrophotographic properties of the electrophotographic photoreceptor sufficiently and broaden the conditions of use by dispersing the metal oxide fine particles having an added acceptor compound in the undercoat layer of the electrophotographic photoreceptor. As a result, even when images are formed in different-length periods from charging to development, it becomes possible to suppress generation of the fogging and black spots on output images and generation of image memory sufficiently.

The reasons for the advantageous effects being gained of the invention are yet to be understood, but the inventors assume the following:

Reasons for the problems described above occurring in conventional image-forming apparatuss will be first described. Undercoat layers used in conventional electrophotographic photoreceptors are formed by dispersing metal oxide fine particles and a binder resin in a solvent and applying the resultant dispersion to a substrate. If the undercoat layer is a thick film having a thickness of more than 5 μm electrically conductive paths are deliberately constructed in the undercoat layer by adding a large amount of metal oxide fine particles thereto for ensuring a sufficiently high charge transporting ability in the undercoat layer. In such a case, a part of the metal oxide fine particles may not be covered with the binder resin and may become exposed on the surface. The exposed metal oxide fine particles form charge injection sites. The charge injection sites become points for injecting charges into the upper layer. Charges injected into the upper layer reach the photoreceptor surface, eliminate the surface charges and consequently cause fogging and black spots especially when the period from charging to development is long. In addition, when the resistance of the undercoat layer is too low, charge injection into the upper layer becomes more significant, making the problem of fogging drastically worse. On the other hand, if the resistance of the undercoat layer is too high, image quality defects such as fogging are more preventable, but a greater amount of charges are accumulated in the undercoat layer or at the interface between the undercoat and the upper layer, leading to an increase in the residual electric potential of an electrophotographic photoreceptor during continuous or long-term use, leading to abnormal density in formed images and greater difficulty to obtain favorable quality images.

For that reason, such an undercoat layer should have a resistance-controlling function and a charge injection-controlling function at the same time in a single layer, which has imposed a great restriction on the design of such apparatus.

After intensive studies to solve the problems described above, the inventors have found that installation of an electrophotographic photoreceptor containing metal oxide fine particles having an added acceptor compound in the undercoat layer in the image-forming apparatus of the invention allows prevention of charge accumulation in the undercoat layer or in the vicinity of the interface between the undercoat and the upper layer, and therefore make it possible to sufficiently and uniformly charge the electrophotographic photoreceptor without generation of abnormalities in electric potential such as deterioration in charge potential during repeated use.

The electrophotographic photoreceptor provides unprecedented excellent electrical properties and image quality characteristics, suppresses generation of fogging and black spots on output images and generation of image memory even when images are formed in different-length periods from charging to development, and further suppresses fluctuation in electrical properties and prevents generation of image density abnormalities sufficiently even when continuously used for an extended period of time.

Thus, the image-forming apparatus enables improvements both in image quality and the life thereof.

A third aspect of the invention provides a process cartridge that is detachable from an image-forming apparatus for forming an image by charging, light exposure, development and transfer while causing the peripheral surface of an electrophotographic photoreceptor to travel in a predetermined direction, the process cartridge comprising: an electrophotographic photoreceptor, a controller that controls the traveling speed of the peripheral surface of the electrophotographic photoreceptor and that thus makes a period from charging to development variable, and at least one selected from a charging unit, a development unit, a transfer unit and a cleaning unit, wherein: the electrophotographic photoreceptor comprises an undercoat layer and a photosensitive layer, and the undercoat layer contains metal oxide fine particles with an acceptor compound added thereto.

The invention provides an image-forming apparatus and a process cartridge that can suppress generation of fogging and black spots on output images and generation of image memory even when images are formed by switching between plural processing modes.

DETAILED DESCRIPTION OF THE INVENTION

Figure 1:
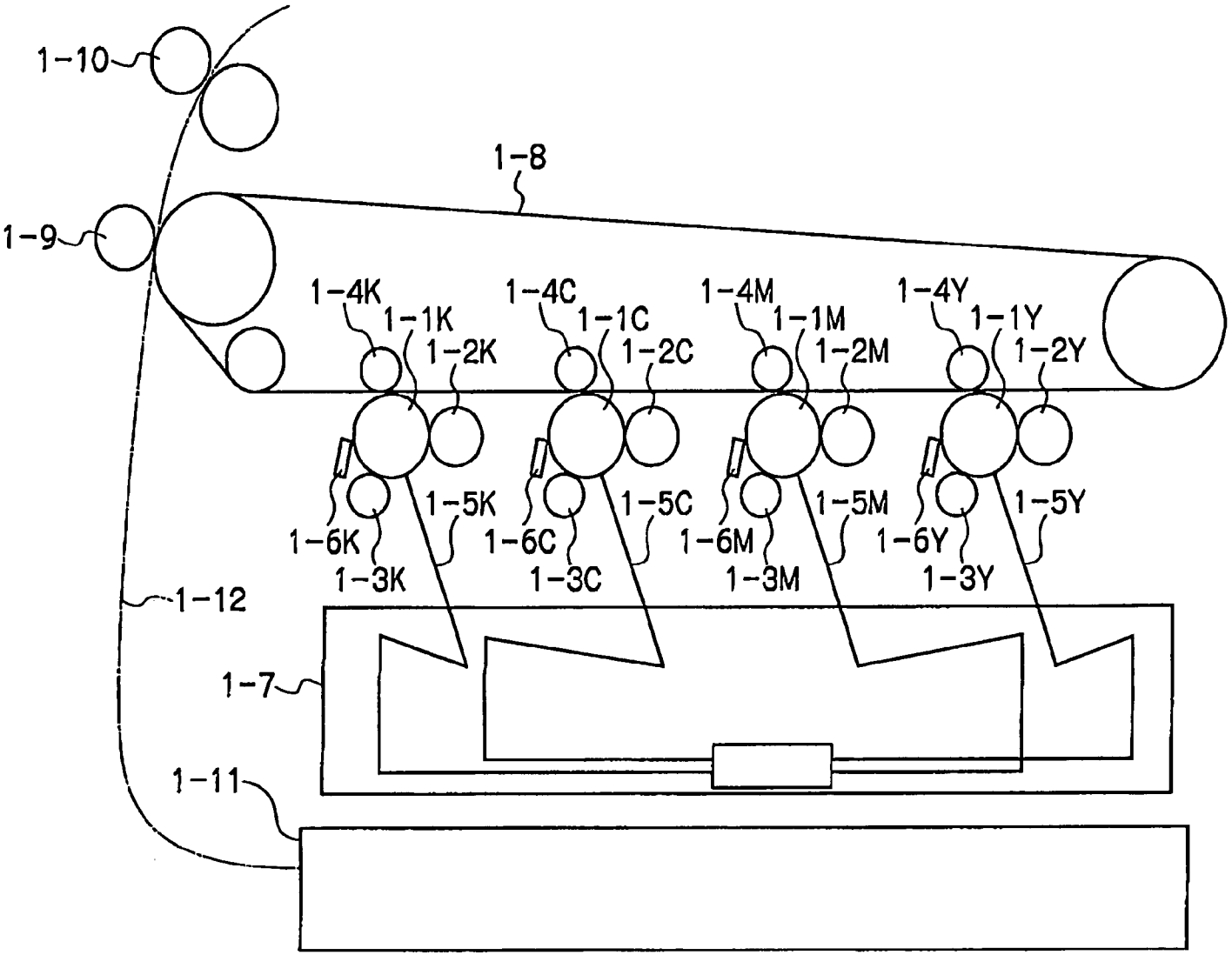
FIG. 1 is a schematic view illustrating the configuration of an embodiment of an image-forming apparatus according to the invention.

Hereinafter, embodiments of the invention will be described in detail occasionally with reference to drawings. In the drawings, identical numbers are allocated to the same or similar parts and duplicate descriptions are omitted.

FIG. 1 is a schematic view illustrating the configuration of an embodiment of an image-forming apparatus according to the invention. The image-forming apparatus shown in FIG. 1 is a so-called tandem digital color printer, wherein image-forming units for respectively forming yellow (Y), magenta (M), cyan (C), and black (K) images are disposed in series with respect to the conveying direction of an image-receiving medium 1-12. Each image-forming unit has an electrophotographic photoreceptor (hereinafter, referred to simply as a "photoreceptor") supported so that it can rotate in a predetermined direction, and a development subunit, a charging roll, a primary transfer roll, an exposure device and a cleaning blade that are disposed along the traveling direction of the peripheral surface of the photoreceptor. A laser beam from the exposure device, ROS (Raster Output Scanner) 1-7, is irradiated on the charged photoreceptor. For example, the black (K) image-forming unit has a photoreceptor 1-1K, a development subunit 1-2K, a charging roll 1-3K, a primary transfer roll 1-4K and a cleaning blade 1-6K and causes an exposure beam 1-5K to be irradiated on the charged photoreceptor 1-1K.

It should be noted that FIG. 1 also illustrates the same structure as discussed above for yellow (Y), magenta (M) and cyan (C), and that the image forming units for yellow, magenta and cyan also have photoreceptors 1-1Y, 1-1M and 1-1C, development subunits 1-2Y, 1-2M and 1-2C, charging roles 1-3Y, 1-3M and 1-3C, primary transfer rolls 1-4Y, 1-4M and 1-4C, cleaning blades 1-6Y, 1-6M and 1-6C, and exposure beams 1-5Y, 1-5M and 1-5C are caused to be irradiated on the charged photoreceptors 1-1Y, 1-1M and 1-1C, respectively.

In such an image-forming apparatus, each of the photoreceptors 1-1Y, 1-1M, 1-1C and 1-1K has an electrically conductive substrate, and an undercoat layer and a photosensitive layer formed on the electrically conductive substrate, and the undercoat layer contains metal oxide fine particles to which an acceptor compound is added. The detail of the configuration of the photoreceptor will be described later.

In addition, a driving device (not shown) is connected to each photoreceptor. The driving device controls the rotational velocity of each photoreceptor (i.e., the traveling speed of the peripheral surface of each photoreceptor), whereby the period from charging to development can be changed in each image-forming unit. Such a control function enables switching between plural control modes including a normal mode, a low-speed mode, and a high-speed mode for image formation.

For example, to form a black image, the photoreceptor 1-1K is first electrically charged by a charging roll 1-3K to which a voltage is applied. Then, a latent image is formed on the photoreceptor by exposing the photoreceptor to a laser beam 1-5K from the ROS (Raster Output Scanner) 1-7, and is developed with a development subunit 1-2K to form a toner image. The toner image is transferred onto an intermediate transfer belt under the electric field applied by a primary transfer roll 1-4K. The toner image is then retransferred onto an image-receiving medium fed from a paper tray 1-11 under the electric field of a secondary transfer roll 1-9 and fixed by a fixing unit 1-10, and the medium carrying the fixed image as a printed image is discharged from the device.

Alternatively, to form a color image in the normal mode, the yellow image-forming unit is first driven. Thereby, a photoreceptor 1-1Y is first electrically charged by a charging roll 1-3Y to which a voltage is applied. Then, an electrostatic latent image is formed on the photoreceptor by exposing the photoreceptor to a laser beam 1-5Y from the ROS 1-7 and converted into a toner image by a development subunit 1-2Y. The same process is carried out by each of magenta (M), cyan (C), and black (K) image-forming units one by one, and the yellow, magenta, cyan and black toner images are piled on the intermediate transfer belt to form a full-color image. Then, the full-color toner image is retransferred onto an image-receiving medium fed from the paper tray 1-11 under the electric field of the secondary transfer roll 1-9 and is thermally fixed by the fixing unit 1-10. The medium carrying the fixed image as a printed image is discharged from the device.

The rotational velocity of the photoreceptor in the normal mode is not particularly limited, but is preferably set so that the period from charging to development be about 50 to about 300 msec in each image-forming unit.

If cardboard or an OHP sheet is used as the image-receiving medium fed from the paper tray, it is preferable to set an image-forming mode to the low-speed mode. In other words, it is preferable to lengthen the period from to development and the period for fixing in each image-forming unit. Lengthening the period from charging to development is attained by slowing down the rotational velocity of the photoreceptor 1-1. The reason why the period for fixing is preferably lengthened is that a developer can thereby be sufficiently fixed even when cardboard or an OHP sheet is used. The procedure for image formation in the low-speed mode is the same as that in the normal mode. In addition, the rotational velocity of the photoreceptor (the traveling speed of the peripheral surface of each photoreceptor) in the low-speed mode is not particularly limited, but is preferably controlled to satisfy the condition represented by the following Formula (1).

$$T_{low} \geqq (1/3)T \qquad \text{Formula (1)}$$

In the formula, T represents the period from charging to development when an electrophotographic process is conducted in a normal mode; and $T_{low}$ represents that when the electrophotographic process is carried out in a low-speed mode.

When a monochromic image (black and white image) is output, the black (K) image-forming unit is driven. Thereby, the photoreceptor 1-1K is first electrically charged by the charging roll 1-3K to which a voltage is applied. An electrostatic latent image is formed on the photoreceptor by exposing the photoreceptor to a laser beam 1-5K from the ROS 1-7 and is developed by the development subunit 1-2K to form a toner image. Then, the toner image is transferred onto the intermediate transfer belt 1-8 under the electric field of the primary transfer roll 1-4K. Further, the toner image is retransferred onto an image-receiving medium fed from the paper tray 1-11 under the electric field of the secondary transfer roll 1-9; the resulting image is thermally fixed on the image-receiving medium with the fixing unit 1-10; and the medium carrying the fixed image as a printed image is discharged from the device. For formation of such monochromic images, the image-forming mode is set to a high-speed mode, thus accelerating the rotational velocity of the photoreceptor 1-1K and shortening the period from charge to development The rotational velocity of the photoreceptor in the high-speed mode (the traveling speed of the peripheral surface of the photoreceptor) is not particularly limited, but is preferably controlled to satisfy the condition represented by the following Formula (2).

$$T_{high} \leqq 3T(2) \qquad \text{Formula (2)}$$

In the formula, T represents the period from charging to development when an electrophotographic process is carried out in a normal mode; and $T_{high}$ represents that when the electrophotographic process is carried out in a high-speed mode.

As described above, presence of metal oxide fine particle to which an acceptor compound is applied in the undercoat layer of each of the photoreceptors 1-1Y, 1-1M, 1-1C and 1-1K of the tandem color image-forming apparatus sufficiently improves the electrophotographic properties of each of the photoreceptors and loosens conditions of use thereof. Accordingly, it becomes possible to sufficiently suppress generation of fogging and black spots on the output image and generation of image memory, even when the period from charging to development is altered by switching between the normal mode, high-speed mode, and low-speed mode.

Each of the units of the image-forming apparatus according to the invention will be described below.

First, the configuration of the photoreceptor will be described.

Figure 2:
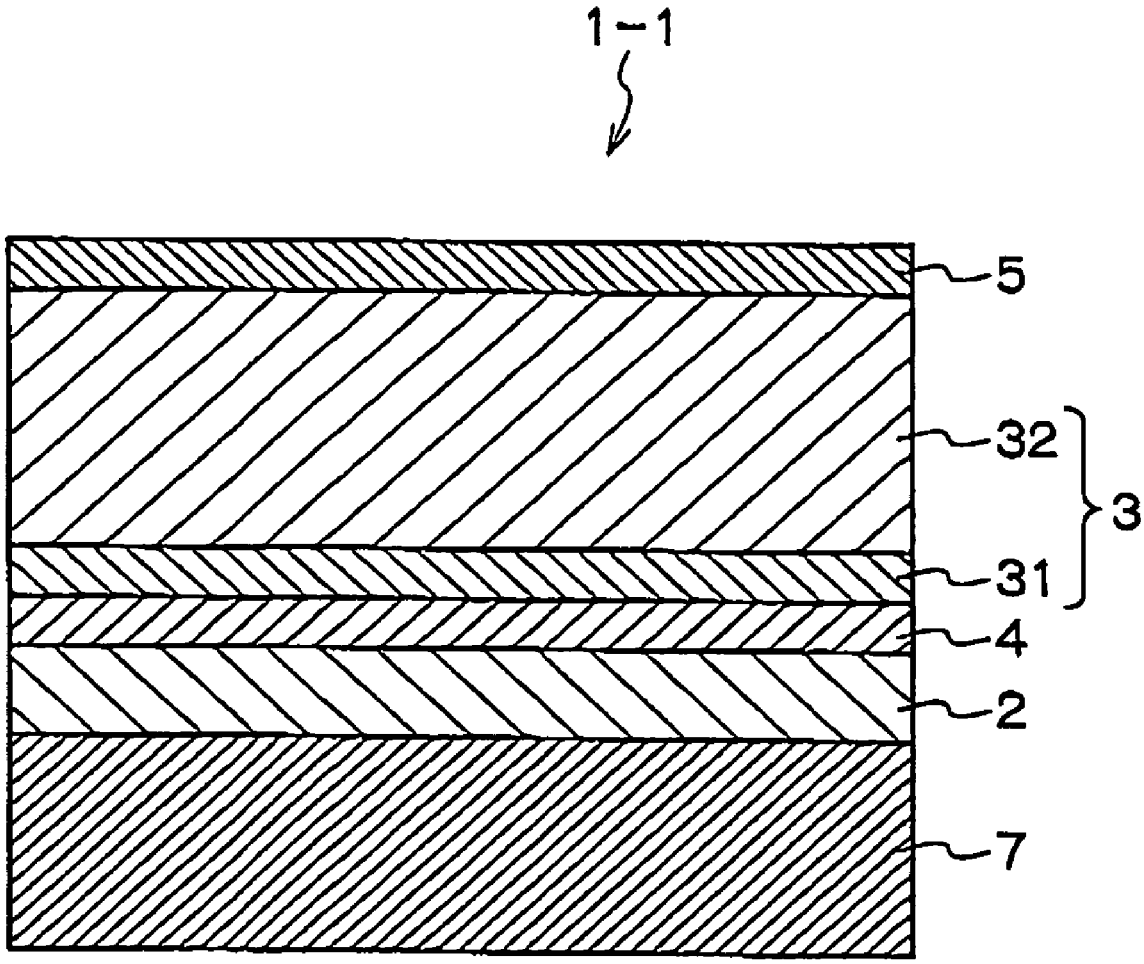
FIG. 2 is a schematic cross-sectional view illustrating the configuration of an embodiment of an electrophotographic photoreceptor in the image-forming apparatus according to the invention.

FIG. 2 is a schematic cross-sectional view illustrating the configuration of an embodiment of the electrophotographic photoreceptor of the image-forming apparatus according to the invention. The electrophotographic photoreceptor 1-1 has a laminated structure wherein an undercoat layer 2, an intermediate layer 4, a photosensitive layer 3 and a overcoat layer 5 are laid in that order on an electrically conductive substrate 7. The electrophotographic photoreceptor 1-1 shown in FIG. 2 is one with layers having different functions, and the photosensitive layer 3 has a charge generating layer 31 and a charge transport layer 32.

Examples of the electrically conductive substrate 7 include drums made of a metal such as aluminum, copper, iron, stainless steel, zinc, or nickel; those in which a metal such as aluminum, copper, gold, silver, platinum, palladium, titanium, nickel-chromium, stainless steel, or indium, or an electrically conductive metal compound such as indium oxide or tin oxide is deposited on a substrate made of paper, plastic, or glass; those in which a metal foil is laminated on the above-described substrate; those in which the above-described substrate has been subjected to electrically conductive treatment by applying a dispersion in which carbon black, indium oxide, tin oxide, antimony oxide powder, metal powder or copper iodide is dispersed in a binder resin thereto.

The shape of the electrically conductive substrate 7 is not restricted to the drum shape, and may be a sheet-like shape or a plate-like shape. When the electrically conductive substrate 7 is a metal pipe, the surface of the pipe may be bare, or may be subjected to such treatment as mirror-surface grinding, etching, anodic oxidation, rough grinding, centerless grinding, sand blasting and/or wet honing.

The undercoat layer 2 contains metal oxide fine particles to which an acceptor compound is added.

Any compound may be used as the acceptor compound; as long as it has desired properties. However, the acceptor compound preferably has a quinone group. Furthermore, the acceptor compound more preferably has an anthraquinone structure. Such an acceptor compound is preferably anthraquinone, a hydroxyanthraquinone compound, an aminoanthraquinone compound, an aminohydroxyanthraquinone compound, and/or a derivative thereof. Specific examples thereof include anthraquinone, alizarin, quinizarin, anthrarufin and purpurin.

The content of the acceptor compound added is set such that desired properties can be obtained. It is preferably about 0.01 to about 20 weight % with respect to the metal oxide, and more preferably about 0.05 to about 10 weight % with respect to the metal oxide. An undercoat layer 2 containing the acceptor compound in an amount of less than 0.01 weight % does not have a sufficient accepting capacity to improve prevention of charge accumulation therein, more easily leading to deterioration in maintaining property of the undercoat layer, for example, an increase in residual electric potential during repeated use. Alternatively, an undercoat layer 2 containing the acceptor compound in an amount of more than 20 weight % has disadvantages in that the metal oxide particles often undesirably aggregate, and consequently the metal oxide cannot form desired electrically conductive paths in the undercoat layer 2 during formation of the undercoat layer 2, more easily leading to deterioration in maintaining property of the under coat layer, for example, an increase in residual electric potential during repeated use, and triggering image quality defects of black spots.

The acceptor compound can be uniformly added to the metal oxide fine particles, for example, by dripping a solution in which the acceptor compound is dissolved in an organic solvent or by spraying the solution together with dry air or a nitrogen gas on the metal oxide fine particles, which are being agitated with a high-shearing force mixer. The addition or spraying of the acceptor compound solution is preferably carried out at a temperature equal to or lower than the boiling point of the solvent. When the spraying is carried out at a temperature of higher than the boiling point of the solvent, the solvent evaporates before uniform agitating of the solution and the acceptor compound particles locally aggregate and thereby uniform processing cannot be conducted. After the addition or spraying, the metal oxide fine particles may be dried at a temperature equal to or higher than the boiling point of the solvent. Alternatively, the acceptor compound is added to the metal oxide fine particles by uniformly adding the acceptor compound solution to the metal oxide fine particles dispersed in a solvent with an agitator, an ultrasonicator, a sand mill, an attritor or a ball mill, agitating the resultant mixture under reflux or at a temperature equal to or lower than the boiling point of the organic solvent, and removing the solvent. The solvent is usually removed by filtration, distillation, or heat drying.

The powder resistance (volume resistivity) of the metal oxide fine particles to which the acceptor compound is to be added should be about $10^2$ to about $10^{11}$ Ωcm. This is because the undercoat layer 2 should have a suitable resistance to acquire leak resistance. Metal oxide fine particles having a resistance lower than the lower limit of the above range may not provide sufficient leak resistance, while those having a resistance higher than the upper limit of the range may cause an increase in residual electric potential.

The metal oxide fine particles are preferably titanium oxide, zinc oxide, tin oxide and/or zirconium oxide fine particles having a resistance in the above range. The metal oxide fine particles are more preferably zinc oxide fine particles. Two or more kinds of metal oxide fine particles subjected to different surface treatments or having different diameters may be used as a mixture.

In addition, the metal oxide fine particles preferably have a specific surface area of 10 $m^2/g$ or more. Metal oxide fine particles having a specific surface area of lower than 10 $m^2/g$ easily cause deterioration in electrostatic properties, making it difficult to obtain good electrophotographic properties.

The metal oxide fine particles may be subjected to surface treatment before addition of the acceptor compound. Any known surface treating agent may be used, as long as it provides desired properties. Examples thereof include coupling agents such as silane coupling agents, titanate coupling agents, and aluminum coupling agents; and surface-active agents. Use of a silane coupling agent is particularly favorable, since it provides good electrophotographic properties. Typical examples of the silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-aminoethyl)-γ-aminopropylmethylmethoxysilane, N,N-bis(β-hydroxyethyl)-γ-aminopropyltriethoxysilane, and γ-chloropropyltrimethoxysilane. In addition, two or more of these coupling agents may be used as a mixture.

Further, an amino group-containing silane coupling agent is preferably used, since it can provide the undercoat layer 2 with a good blocking property.

The amino group-containing silane coupling agent is not particularly limited, as long as it provides the electrophotographic photoreceptor with good properties. Typical examples thereof include, but are not limited to, γ-aminopropyltriethoxysilane, N-β-(aminoethyl)-γ-aminopropyltrimethoxysilane, N-β-aminoethyl)-γ-aminopropylmethylmethoxysilane, and N,N-bis(β-hydroxyethyl)-γ-aminopropyltrieoxysilane.

Two silane coupling agents may be used together. Examples of the silane coupling agent that may be used together with the amino group-containing silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Any known method may be used as a surface treatment method, and specifically dry and wet methods can be used.

When dry surface treatment is carried out, the metal oxide fine particles are uniformly processed by adding a silane coupling agent directly or spraying a solution, in which the silane coupling agent is dissolved in an organic solvent, together with dry air or nitrogen gas stream onto the metal oxide particles, which are being agitated with a high-shearing force mixer. The addition or spraying is preferably carried out at a temperature equal to or lower than the boiling point of the solvent. When spraying is carried out at a temperature of higher than the boiling point of the solvent, the solvent evaporates before uniform agitating of the silane coupling agent and the silane coupling agent becomes localized, making it difficult to conduct uniform processing. The metal oxide fine particle may be baked at a temperature of 100° C. or more after the addition or spraying. The baking temperature and time may be set such that desirable electrophotographic properties can be obtained.

In wet methods, the metal oxide fine particles are processed uniformly by dispersing the metal oxide fine particles in a solvent with an agitator, an ultrasonicator, a sand mill, an attritor, or a ball mill, adding a silane coupling agent solution to the particles, agitating the resulting mixture, and removing the solvent. The solvent is usually removed by filtration or distillation. The metal oxide fine particles may be baked at a temperature of 100° C. or more. The baking temperature and time may be set such that desirable electrophotographic properties can be obtained. In the wet methods, moisture contained in the metal oxide fine particles may be removed before the addition of a surface treating agent, for example, by heating and agitating the particles in a solvent used in surface treatment or by azeotropic distillation of water and the solvent.

The amount of the silane coupling agent with respect to that of the metal oxide fine particles in the undercoat layer 2 may be freely selected, as long as it is proper for providing desired electrophotographic properties.

The binder resin for use in the undercoat layer 2 is not particularly limited, as long as it forms a good film and provides the film with desired properties. The binder resin can be a known polymer resin compound. Examples thereof include acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins. The binder resin can also be a charge transport resin having a charge transport group or an electrically conductive resin such as polyaniline. Among them, a resin insoluble in coating solutions for layers on or above the undercoat layer is preferable as the binder resin. Typical examples thereof include phenol resins, phenol-formaldehyde resins, melamine resins, urethane resins, and epoxy resins.

The ratio of the metal oxide fine particles to the binder resin in the coating solution for forming an undercoat layer 2 may be freely selected, as long as an electrophotographic photoreceptor with desired properties can be obtained.

Various additives may be added to the coating solution for forming an undercoat layer 2 in order to improve electrical properties, environmental stability, and/or image quality.

Examples of such additives include electron transport materials including quinone compounds such as chloranil and bromoanil, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds such as 3,3',5,5'-tetra-t-butyldiphenoquinone; electron transport pigments such as polycyclic condensates and azo pigments; zirconium chelate compounds, titanium chelate compounds, aluminum chelate compounds, titanium alkoxide compounds, organic titanium compounds, and silane coupling agents. A silane coupling agent is used in surface treatment of zinc oxide, but may be added to the coating solution as an additive. Typical examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Examples of the zirconium chelate compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the titanium chelate compound include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethylester, titanium triethanol aminate, and polyhydroxytitanium stearate.

Examples of the aluminum chelate compound include aluminum isopropylate, monobutoxyaluminum diisopropylate, aluminum butylate, diethylacetoacetatoaluminum diisopropylate, and aluminum tris(ethylacetoacetate).

One of these compound may be used alone or two or more of them can be used as a mixture or polycondensate.

The solvent used in the coating solution for forming an undercoat layer may be selected freely from known organic solvents, such as alcohols, aromatic compounds, halogenated hydrocarbons, ketones, ketone alcohols, ethers, and esters. More specifically, an ordinary organic solvent such as methanol, ethanol, n-propanol, iso-propanol, n-butanol, benzyl alcohol, methylcellosolve, ethylcellusolve, acetone, methyl ethyl ketone, cyclohexanone, methyl acetate, ethyl acetate, n-butyl acetate, dioxane, tetrahydrofuran, methylene chloride, chloroform, chlorobenzene, and toluene may be used as such.

One of these solvents for dispersion may be used alone or two or more of them can be used as a mixture. In a case of a mixture of two or more solvents, any mixed solvent can be used, as long as it can dissolve the binder resin.

Known methods using a roll mill, a ball mill, a vibration ball mill, an attritor, a sand mill, a colloid mill, and a paint shaker may be used to disperse the metal oxide fine particles. In addition, application methods for use in forming the undercoat layer 2 include ordinary methods such as blade coating, wire bar coating, spray coating, dip coating, bead coating, air knife coating, and curtain coating methods.

The undercoat layer 2 is formed on the electrically conductive substrate 7 using the coating solution for forming an undercoat layer 2 thus obtained.

The undercoat layer 2 preferably has a Vickers' strength of 35 or more. In addition, the undercoat layer 2 preferably has a thickness of 15 μm or more, and more preferably a thickness of about 20 to about 50 μm.

An undercoat layer 2 having a thickness of less than 15 μm has a drawback of not providing sufficient leak resistance, while an undercoat layer having a thickness of more than 50 μm has a drawback of leading to image density abnormalities due to residual electric potential easily remaining during long-term use.

For prevention of Moire images, the surface roughness of the undercoat layer 2 is adjusted to about ¼n (n is the refractive index of an upper layer) to about ½ of the wavelength λ of exposure laser beam used. Resin particles may be contained in the undercoat layer for adjustment of the surface roughness. The resin particles are, for example, silicone resin particles and/or cross-inked PMMA resin particles.

In addition, the undercoat layer 2 may be polished for adjustment of the surface roughness, and examples of polishing methods include buffing, sand blasting, wet honing, and grinding treatment.

An intermediate layer 4 may be formed between the undercoat layer 2 and the photosensitive layer 3 for improvements in electrical properties, image quality, image quality endurance, and adhesiveness between the undercoat layer and the photosensitive layer.

The materials of the intermediate layer 4 include polymer resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins; and organic metal compounds containing zirconium, titanium, aluminum, manganese, and/or silicon atoms. One of these compounds may be used alone or two or more of them can be used as a mixture or polycondensate. Among them, a zirconium- or a silicon-containing organic metal compound is superior in various properties, since it has low residual electric potential and exhibits small fluctuations in electric potential caused by the environment and in electric potential caused by repeated use.

Examples of the silicon compound include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxylsilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxylsilane, and γ-chloropropyltrimethoxysilane. The silicon compound is particularly favorably a silane coupling agent such as vinyltriethoxylsilane, vinyltris(2-nethoxyethoxy)silane, 3-methacryloxypropyltrinethoxysilane, 3-glycidoxypropyltrimethoxysilane, 2-3,4-epoxycyclohexyl) ethyltrimethoxysilane, N-2-aminoethyl)-3-aminopropyltrimethoxysilane, N-2-aminoethyl)-3-aminopropylmethyldimethoxysilane, 3-aminopropyltriethoxylsilane, N-phenyl-3-aminopropyltrimethoxysilane, 3-mercaptopropyltrimethoxysilane, and 3-chloropropyltrimethoxysilane.

Examples of the organic zirconium compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the organic titanium compound include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethylester, titanium triethanol aminate, and polyhydroxytitanium stearate.

Examples of the organic aluminum compound include aluminum isopropylate, monobutoxyaluminum diisopropylate, aluminum butylate, diethylacetoacetatoaluminum diisopropylate, and aluminum tris(ethylacetoacetate).

The intermediate layer 4 not only improves the coating properties of layers on or above the intermediate layer but also serves as an electrical blocking layer. However, a too thick intermediate layer becomes more electrically resistant, leading to a decrease in sensitivity of the photoreceptor and an increase in electric potential due to repeated use. Accordingly, if formed, the intermediate layer 4 has a thickness in the range of about 0.1 to about 5 μm.

The charge generating layer 31 in the photosensitive layer 3 is formed by vacuum-depositing a charge generating material or by coating a dispersion containing such a material, a binder resin and an organic solvent to the undercoat or intermediate layer, or a charge transport layer described later.

If formed by dispersion and coating, the charge generating layer 31 is formed by dispersing a charge generating material together, a binder resin, and additives in an organic solvent, and coating the dispersion thus obtained.

Any known charge generating substance may be used as the charge generating material in the invention. Examples of those for infrared light include phthalocyanine pigments, squarylium compounds, bisazo compounds, trisazo pigments, perylene compounds, and dithioketopyrrolopyrrole. Examples of those for visible light include condensed polycyclic pigments, bisazo compounds, perylene compounds, trigonal selenium compounds, and dye-sensitized zinc oxide fine particles. Charge generating materials providing excellent properties and therefore particularly favorably used are phthalocyanine pigments and azo pigments. Use of a phthalocyanine pigment enables production of an electrophotographic photoreceptor having particularly superior sensitivity and stability during repeated use.

Phthalocyanine pigments and azo pigments generally have several crystal forms. A phthalocyanine or azo pigment having any of these crystal forms may be used, as long as it can provide desirable electrophotographic properties. Typical examples of the phthalocyanine pigment include chlorogallium phthalocyanine, dichlorotin phthalocyanine, hydroxygallium phthalocyanine, metal-free phthalocyanine, oxytitanylphthalocyanine, and chloroindium phthalocyanine.

The phthalocyanine pigment crystals may be prepared by mechanical, dry pulverization of a phthalocyanine pigment prepared in accordance with a known method with an automatic mortar, a planetary mill, a vibration mill, a CF mill, a roller mill, a sand mill and/or a kneader, and optionally by wet pulverization of the crystal obtained by the dry pulverization in a solvent with a ball mill, a mortar, a sand mill and/or a kneader.

Examples of the solvent used in the process described above include aromatic compounds (e.g., toluene, and chlorobenzene), amides (e.g., dimethylformamide, and N-methylpyrrolidone), aliphatic alcohols (e.g., methanol, ethanol, and butanol), aliphatic polyhydric alcohols (e.g., ethylene glycol, glycerol, and polyethylene glycol), aromatic alcohols (e.g., benzyl alcohol, and phenethyl alcohol), esters (e.g., acetic acid esters, including butyl acetate), ketones (e.g., acetone, and methyl ethyl ketone), dimethylsulfoxide, and ethers (e.g., diethyl ether, and tetrahydrofuran), and mixtures thereof, and mixtures each including at least one of these organic solvents and water. The amount of the solvent is in the range of about 1 to about 200 parts, and preferably about 10 to about 100 parts by weight with respect to the pigment crystals. The processing temperature is in the range of about −20° C. to the boiling point of the solvent and more preferably in the range of about −10 to about 60° C. A grinding aid such as sodium chloride and/or Glauber's salt may be additionally used during pulverization. The amount of the grinding aid is about 0.5 to about 20 times, and preferably about 1 to about 10 times as much as that of the pigment.

The crystalline state of phthalocyanine pigment crystal prepared in accordance with a known method can be controlled with acid pasting or a combination of the acid pasting and the dry or wet pulverization described above. An acid for use in the acid pasting is preferably sulfuric acid at a concentration of about 70 to 100%, and preferably of about 95 to 100%. The solubilization temperature is in the range of about −20 to about 100° C. and preferably in the range of about −10 to about 60° C. The amount of conc. sulfuric acid is about 1 to about 100 times, and preferably about 3 to about 50 times as much as that of phthalocyanine pigment crystal. Water or a mixture of water and an organic solvent is used in an arbitrary amount as a solvent for precipitating the crystal. The precipitation temperature is not particularly limited, but the pigment crystals are preferably cooled, for example, with ice for prevention of heat generation.

Hydroxygallium phthalocyanine, which is most preferably used among them, has diffraction peaks at Bragg angles (2θ±0.2°) of 7.5°, 9.9°, 12.5°, 16.3°, 18.6°, 25.1°, and 28.3° as determined by using X-ray having Cukα characteristics. I-type hydroxygallium phthalocyanine used as a raw material in preparation of hydroxygallium phthalocyanine can be prepared in accordance with any known method. An example thereof is shown below.

First, crude gallium phthalocyanine is produced, for example, by a method of reacting o-phthalodinitrile or 1,3-diiminoisoindoline with gallium trichloride in a predetermined solvent (I-type chlorogallium phthalocyanine method); or a method of preparing phthalocyanine dimer by heating and allowing o-phthalodinitrile, an alkoxy gallium, and ethylene glycol to react in a predetermined solvent (phthalocyanine dimer method). Examples of the solvent preferably used in the above reactions include inactive, high-boiling point solvents such as α-chloronaphthalene, β-chloronaphthalene, α-methylnaphthalene, methoxynaphthalene, dimethylaminoethanol, diphenylethane, ethylene glycol, dialkylethers, quinoline, sulfolane, dichlorobenzene, dimethylformamide, dimethylsulfoxide, and dimethylsulfoamide.

The crude gallium phthalocyanine thus obtained is then subjected to acid pasting treatment, which converts the crude gallium phthalocyanine into fine particles of I-type hydroxygallium phthalocyanine pigment. Specifically, the acid pasting treatment is recrystallization of gallium phthalocyanine, for example, by pouring a solution in which the crude gallium phthalocyanine is dissolved in an acid such as sulfric acid into an aqueous alkaline solution, water or ice water, or by adding an acid salt of the crude gallium phthalocyanine such as a sulfate salt to the aqueous alkaline solution, water or ice water. The acid used in the acid pasting treatment is preferably sulfuric acid, and the sulfuric acid preferably has a concentration of about 70 to 100% (more preferably about 95 to 100%).

The hydroxygallium phthalocyanine usable in the invention can be obtained by pulverizing the I-type hydroxygallium phthalocyanine pigment obtained by the acid pasting treatment in a solvent and thus altering the crystal form of the pigment. This wet pulverization treatment is preferably carried out with a pulverizer employing spherical media having an outer diameter of about 0.1 to about 3.0 mm, more preferably employing those having an outer diameter of about 0.2 to about 2.5 mm. If the outer diameter of the media is greater than 3.0 mm, pulverization efficiency deteriorates and the hydroxygallium phthalocyanine particles do not become smaller and easily aggregate. Alternatively, if it is less than 0.1 mm, it becomes difficult to separate hydroxygallium phthalocyanine powder from the media. In addition, when the media have a shape other than sphere such as a cylindrical or irregular shape, pulverization efficiency lowers, and the media easily wear due to pulverization, and fractured powders occurring from wear of the media serves as impurities and accelerate deterioration of the properties of hydroxygallium phthalocyanine.

Any material may be used for the media, but the media is preferably made of what never or hardly causes image quality defects even when introduced into the pigment, such as glass, zirconia, alumina, or agate.

Any material may be used for the container, but the container is preferably made of what never or hardly causes image quality defects even when introduced into the pigment, such as glass, zirconia, alumina, agate, polypropylene, TEFLON (registered trade name), and/or polyphenylene sulfide. Further, the internal surface of a container made of a metal such as iron or stainless steel may be lined with glass, polypropylene, TEFLON (registered trade name) and/or polyphenylene sulfide.

The amount of the media used may depend on the type of a device used, but is generally 50 parts by weight or more, and preferably about 55 to about 100 parts by weight with respect to 1 part by weight of I-type hydroxygallium phthalocyanine pigment. When the weight of the media is constant, a decrease in the outer diameter of the media leads to an increase in the density of the media in the device, an increase in the viscosity of the mixture solution and a change in pulverization efficiency. Therefore, it is preferable to conduct wet pulverization at a controlled, optimal mixing rate of the amounts of the media and the solvents used, as the medium outer diameter is reduced.

The temperature of the wet pulverization treatment is generally in the range of about 0 to about 100° C., preferably in the range of about 5 to about 80° C., and more preferably in the range of about 10 to about 50° C. Wet pulverization at a lower temperature results in slowdown of crystal conversion, while that at an excessively high temperature results in an increase in the solubility of hydroxygallium phthalocyanine and crystal growth, making it difficult to produce fine particles.

Examples of the solvent for use in the wet pulverization treatment include amides such as N,N-dimethylformamide, N,N-dimethylacetamide, and N-methylpyrrolidone; esters such as ethyl acetate, n-butyl acetate, and iso-amyl acetate; ketones such as acetone, methyl ethyl ketone, and methyl isobutyl ketone; and dimethylsulfoxide. The amount of the solvent used is usually about 1 to about 200 parts by weight, and preferably about 1 to about 100 parts by weight with respect to 1 part by weight of the hydroxygallium phthalocyanine pigment.

Examples of an apparatus used in the wet pulverization treatment include mills employing a dispersion medium such as a vibration mill, an automatic mortar, a sand mill, a dyno mill, a cobalt mill, an attritor, a planetary ball mill, and a ball mill.

The progress speed of the crystal conversion is significantly influenced by the scale, agitating speed and the material of the media of the wet pulverization process. The process is continued until the original crystal form of hydroxygallium phthalocyanine is converted to the desired crystal form thereof. At this time, the crystal-converting state of hydroxygallium phthalocyanine is monitored by measuring the light absorption of the solution, which is being subjected to wet pulverization. The process is continued until the absorption peak of the hydroxygallium phthalocyanine which absorption peak is maximum in the spectroscopic absorption spectrum of 600 to 900 nm becomes within the range of 810 to 839 nm. Generally, the duration of the wet pulverization treatment is generally in the range of about 5 to about 500 hours and preferably in the range of about 7 to about 300 hours. A treatment period of shorter than 5 hours may result in incomplete crystal conversion, leading to deterioration in electrophotographic properties, in particular, in sensitivity. A treatment period of longer than 500 hours may cause decreases in sensitivity and productivity, and contamination of the pigment with fractured powder of the medium due to the influence of pulverization stress. Wet pulverization continued for the period of time described above allows the hydroxygallium phthalocyanine particles to be uniformly pulverized and converted into fine particles.

The binder resin for use in the charge generating layer 31 may be selected from a wide variety of insulating resins or from organic photoconductive polymer such as poly-N-vinylcarbazole, polyvinylanthracene, polyvinylpyrene, and polysilane. Typical examples of the binder resin include, but are not limited to, polyvinylacetal resins, polyarylate resins (e.g., poly-condensed polymers made from bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins and polyvinylpyrrolidone resins. One of these binder resins may be used alone, or two or more of them can be used as a mixture. Among them, the binder resin is particularly preferably a polyvinyl acetal resin.

The blending ratio (weight ratio) of the charge generating material to the binder resin in the coating solution for forming a charge generating layer is preferably in the range of 10:1 to 1:10. The solvent used in the coating solution may be selected arbitrarily from known organic solvents such as alcohols, aromatic compounds, halogenated hydrocarbons, ketones, ketone alcohols, ethers, and esters. Specific examples thereof include ordinary organic solvents such as methanol, ethanol, n-propanol, iso-propanol, n-butanol, benzyl alcohol, methylcellosolve, ethylcellusolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

One of these solvents for use in dispersion may be used alone, or two or more of them can be used as a mixture. When two or more solvents are mixed, these are selected such that the mixed solvent can dissolve the binder resin.

Examples of a dispersion method include methods using a roll mill, a ball mill, a vibration ball mill, an attritor, a sand mill, a colloid mill and a paint shaker. A method for applying a coating solution for a charge generating layer to the undercoat or intermediate layer can be any common method including blade coating, wire bar coating, spray coating, dip coating, bead coating, air knife coating and curtain coating methods.

Further, it is effective to adjust the size of dispersed particles to a value in the rage of of 0.5 μm or less, preferably 0.3 μm or less, and more preferably 0.15 μm or less in improving sensitivity and stability.

The charge generating substance may be surface-treated for improvement in the stability of electrical properties and prevention of image quality defects. Such surface treatment improves dispersing property of the charge generating substance and coatability of the coating solution for a charge generating layer, enables easy and secure production of a smooth charge generating layer 31 in which the substance is uniformly dispersed, consequently suppresses image quality defects such as fogging and ghosts, and thus improves image quality endurance. It also improves the storage life of the coating solution for a charge generating layer and thus is effective in extending the pot life thereof, enabling cost reduction of the photoreceptor.

An organic metal compound or a silane coupling agent having a hydrolyzable group may be used as the surface-treating agent.

The organic metal compound or the silane coupling agent having a hydrolyzable group is preferably represented by the following Formula (A):

$$Rp\text{-}M\text{-}Yq \qquad \text{Formula (A)}$$

In the formula, R represents an organic group; M represents a metal other than an alkali metal, or a silicon atom; Y represents a hydrolyzable group; and p and q each are an integer of 1 to 4 and the total of p and q is equivalent to the valence of M.

Examples of the organic group represented by R in Formula (A) include alkyl groups such as methyl, ethyl, propyl, butyl, and octyl groups; alkenyl groups such as vinyl and allyl groups; cycloalkyl groups such as a cyclohexyl group; aryl groups such as phenyl and naphthyl groups; alkylaryl groups such as a toluyl group; arylalkyl groups such as benzyl and phenylethyl group; arylalkenyl groups such as a styryl group; and heterocyclic residues such as furyl, thienyl, pyrrolidinyl, pyridyl, and imidazolyl groups. The organic group may have one or more substituents.

Examples of the hydrolyzable group represented by Y in Formula (A) include ether groups such as methoxy, ethoxy, propoxy, butoxy, cyclohexyloxy, phenoxy, and benzyloxy group; ester groups such as acetoxy, propionyloxy, acryloxy, methacryloxy, benzoyloxy, methanesulfonyloxy, benzenesulfonyloxy, and benzyloxycarbonyl groups; and halogen atoms such as a chlorine atom.

In Formula (A), M is not particularly limited, if it is not an alkali metal. M is preferably a titanium atom, an aluminum atom, a zirconium atom, or a silicon atom. Accordingly, organic-titanium compounds, organic aluminum compounds, organic zirconium compounds, and silane coupling agents which are substituted with the organic group or hydrolyzable group described above are preferably used in the invention.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-aminoethyl)-γ-aminopropylmethylmethoxysilane, N,N-bis(β-hydroxyethyl)-γ-aminopropyltriethoxysilane and γ-chloropropyltrimethoxysilane. Among them, the silane coupling agent is more preferably vinyltriethoxysilane, vinyltris(2-methoxyethoxy)silane, 3-methacryloxypropyltrimethoxysilane, 3-glycidoxypropyltrimethoxysilane, 2-3,4-epoxycyclohexyl)ethyltrimethoxysilane, N-2-aminoethyl)-3-aminopropyltrimethoxysilane, N-2-aminoethyl)-3-aminopropylmethyldimethoxysilane, 3-aminopropyltriethoxysilane, N-phenyl-3-aminopropyltrimethoxysilane, 3-mercaptopropyltrimethoxysilane, and/or 3-chloropropyltrimethoxysilane.

Examples of the organic zirconium compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the organic titanium compound include tetraisopropyl titanate, tetra-n-butyl titanate, butyl titanate dimer, tetra(2-ethylhexyl)titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate. Examples of the organic aluminum compound include aluminum isopropylate, monobutoxyaluminum diisopropylate, aluminum butylate, diethylacetoacetatoaluminum diisopropylate, and aluminum tris(ethylacetoacetate).

Hydrolysates of the organic metal compounds and the silane coupling agents may also be used. Examples of the hydrolysate include those in which Y (hydrolyzable group) bonding to M (a metal atom other than an alkali metal, or a silicon atom) in the organic metal compound represented by the formula described above and/or an hydrolyzable group bonding to R (organic group) has been hydrolyzed. I this case, if the organic metal compound or the silane coupling agent has plural hydrolyzable groups, it is unnecessary that all the functional groups on the compound have been hydrolyzed. In other words, a partially hydrolyzed product may be used in the invention. One of these organic metal compounds and the silane coupling agents may be used alone, or two or more of them can be used together.

Examples of a method for coating a phthalocyanine pigment with an organic metal compound and/or a silane coupling agent having a hydrolyzable group (hereinafter, referred to simply as "organic metal compound") include a method for coating the phthalocyanine pigment with the agent at the time that the crystal form of the phthalocyanine pigment is being changed, a method for conducting the coating treatment before the phthalocyanine pigment is dispersed in the binder resin, a method for mixing the organic metal compound with the pigment in dispersing the phthalocyanine pigment in the binder resin, and a method for dispersing an organic metal compound in a binder resin in which the phthalocyanine pigment has been dispersed.

More specifically, examples of the method for conducting the coating treatment at the time that the crystal form of the phthalocyanine pigment is being changed include a method for mixing the organic metal compound with the phthalocyanine pigment whose crystal form has not been changed and heating the resultant mixture, a method for mixing the organic metal compound with the phthalocyanine pigment whose crystal form has not been changed and mechanically pulverizing the resultant mixture in a dry manner, and a method for mixing a liquid mixture in which the organic metal compound is dissolved in water or an organic solvent with the phthalocyanine pigment whose crystal form has not been changed and conducting wet-pulverization treatment.

Examples of the method for conducting the coating treatment before the phthalocyanine pigment is dispersed in the binder resin include a method for mixing the organic metal compound, water or a liquid mixture of water and an organic solvent, and the phthalocyanine pigment and heating the resultant mixture, a method for directly spraying the organic metal compound on the phthalocyanine pigment, and a method for mixing and milling the organic metal compound and the phthalocyanine pigment.

Further, examples of the method for mixing the organic metal compound with the pigment in dispersing the phthalocyanine pigment in the binder resin include a method for sequentially adding the organic metal compound, the phthalocyanine pigment, and the binder resin to a dispersion solvent and stirring the resultant mixture, and a method for simultaneously adding these components of a charge generating layer to a solvent and mixing the resultant.

Various additives may be added to the coating solution for a charge generating layer to improve electrical properties of the layer and image quality. The additives can be known materials. Examples thereof include electron transport materials including quinone compounds such as chloranil, bromoanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-(4-biphenyl)-5-(4t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, diphenoquinone compounds such as 3,3',5,5'-tetra-t-butyl diphenoquinone; electron transport pigments such as polycyclic condensed compounds, and azo pigments; zirconium chelate compounds, titanium chelate compounds, aluminum chelate compounds, titanium alkoxide compounds, organic titanium compounds, and silane coupling agents.

Examples of the silane coupling agent include vinyltrimethoxysilane, γ-methacryloxypropyl-tris(β-methoxyethoxy)silane, β-3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β(aminoethyl)-γ-aminopropylmethylmethoxysilane, N,N-bis(β-hydroxyethyl)-γ-aminopropyltriethoxysilane and γ-chloropropyltrimethoxysilane.

Examples of the zirconium chelate compound include zirconium butoxide, ethyl zirconium acetoacetate, zirconium triethanolamine, acetylacetonatozirconium butoxide, ethyl zirconium butoxide acetoacetate, zirconium acetate, zirconium oxalate, zirconium lactate, zirconium phosphonate, zirconium octanate, zirconium naphthenate, zirconium laurate, zirconium stearate, zirconium isostearate, methacrylatozirconium butoxide, stearatozirconium butoxide and isostearatozirconium butoxide.

Examples of the titanium chelate compound include tetraisopropyl titanate, tetra-n-butyl titanate, butyl titanate dimer, tetra(2ethylhexyl)titanate, titanium acetylacetonate, polytitanium acetylacetonate, titanium octyleneglycolate, titanium lactate ammonium salt, titanium lactate, titanium lactate ethyl ester, titanium triethanol aminate, and polyhydroxytitanium stearate.

Examples of the aluminum chelate compound include aluminum isopropylate, monobutoxyaluminum diisopropylate, aluminum butylate, diethylacetoacetatoaluminum diisopropylate and aluminum tris(ethylacetoacetate).

One of these compound may be used alone, or two or more of them can be used as a mixture or a polycondensate.

A method for applying a coating solution for a charge generating layer 31A to the undercoat or intermediate layer can be an ordinary method. Examples thereof include blade coating, wire bar coating, spray coating, dip coating, bead coating, air knife coating and curtain coating methods.

A silicone oil may also be added in a trace amount to the coating solution as the leveling agent to improve the smoothness of the resultant coated film. The thickness of the charge generating layer 31 is preferably about 0.05 to about 5 μm and more preferably about 0.1 to about 2.0 μm.

A charge transport layer 32 can be a layer produced by a known technique. The charge transport layer contains a charge transport material and a binder resin or a polymeric charge transport material.

Any known compound may be used as the charge transport material contained in the charge transport layer 32 and examples thereof include hole transport materials including oxadiazole derivatives such as 2,5-bis(p-diethyl aminophenyl)-1,3,4-oxadiazole, pyrazoline derivatives such as 1,3,5-triphenyl-pyrazoline and 1-[pyridyl(2)]-3-(p-diethylaminostyryl)-5-(p-diethylaminostyryl)pyrazoline, aromatic tertiary amino compounds such as triphenylamine, tri(p-ethyl)phenylamine, N,N'-bis(3,4-dimethylphenyl)biphenyl-4-amine, dibenzylaniline, and 9,9-dimethyl-N,N'-di(p-tolyl) fluorenone-2-amine, aromatic tertiary diamino compounds such as N,N'-diphenyl-N,N'-bis(3-methylphenyl)-[1,1-biphenyl]-4,4'-diamine, 1,2,4-triazine derivatives such as 3-(4'-dimethylaminophenyl)-5,6-di(4'-methoxyphenyl)-1,2,4-triazine, hydrazone derivatives such as 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone, quinazoline derivatives such as 2-phenyl-4-styryl-quinazoline, benzofuran derivatives such as 6-hydroxy-2,3-di(p-methoxyphenyl)-benzofuran, α-stilbene derivatives such as p-2,2-diphenylvinyl)-N,N'-diphenyl aniline, enamine derivatives, carbazole derivatives such as N-ethylcarbazole, and poly-N-vinylcarbazole and derivatives thereof; electron transport materials including quinone compounds such as chloranil, bromoanil, and anthraquinone, tetracyanoquinodimethane compounds, fluorenone compounds such as 2,4,7-trinitrofluorenone and 2,4,5,7-tetranitro-9-fluorenone, oxadiazole compounds such as 2-4-diphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds such as 3,3',5,5'-tetra-t-butyldiphenoquinone. In addition, a polymer having a group containing the compound described above in the main or side chain can also be used as the charge transport material. One of these charge transport materials may be used alone, or two or more of them can be used together.

Among them, the charge control material is preferably a compound represented by any of the following Formulae (B-1) to (B-3) from the viewpoint of mobility.

(B-1)

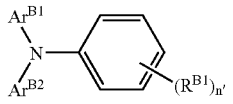

In the formula, $R^{B1}$ represents a methyl group, and n' is an integer of 0 to 2. $Ar^{B1}$ and $Ar^{B2}$ each represent a substituted or unsubstituted aryl group; and the substituent group represents a halogen atom, an alkyl group having 1 to 5 carbon atoms, an alkoxy group having 1 to 5 carbon atoms, or a substituted amino group having as a substituent an alkyl group having 1 to 3 carbon atoms.

(B-2)

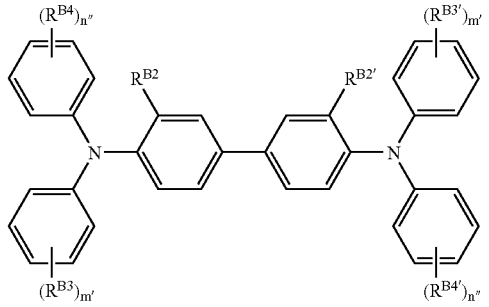

In the formula, $R^{B2}$ and $R^{B2'}$ may be the same or different and each independently represent a hydrogen atom, a halogen atom, an alkyl group having 1 to 5 carbon atoms, or an alkoxy group having 1 to 5 carbon atoms. $R^{B3}$, $R^{B3'}$, $R^{B4}$, and $R^{B4'}$ may be the same or different and each independently represent a hydrogen atom, a halogen atom, an alkyl group having 1 to 5 carbon atoms, an alkoxy group having 1 to 5 carbon atoms, an amino group having as a substituent an alkyl group having one or two carbon atoms, a substituted or unsubstituted aryl group, or, —C($R^{B5}$)═C($R^{B6}$)($R^{B7}$); $R^{B5}$, $R^{B6}$, and $R^{B7}$ each represent a hydrogen atom, a substituted or unsubstituted alkyl group, or a substituted or unsubstituted aryl group. m' and n'' are integers of 0 to 2.

(B-3)

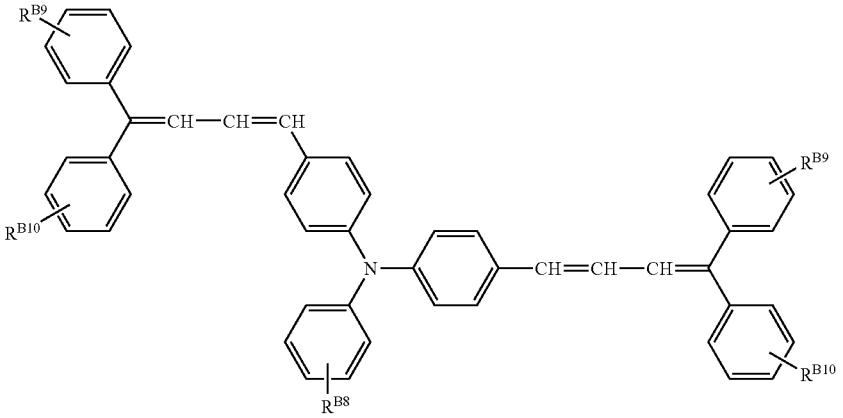

In the formula, $R^{B8}$ represents a hydrogen atom, an alkyl group having 1 to 5 carbon atoms, an alkoxy group having 1 to 5 carbon atoms, a substituted or unsubstituted aryl group, or —CH=CH—CH=C($Ar^{B3}$). $Ar^{B3}$ represents a substituted or unsubstituted aryl group. $R^{B9}$ and $R^{B10}$ may be the same or different and each independently represent a hydrogen atom, a halogen atom, an alkyl group having 1 to 5 carbon atoms, an alkoxy group having 1 to 5 carbon atoms, an amino group having as a substituent an alkyl group having one or two carbon atoms, or a substituted or unsubstituted aryl group.

Any known binder resin may be contained in the charge transport layer 32, but a resin that can form an electrically insulating film is preferable. Examples of the binder resin include, but are not limited to, insulating resins such as polycarbonate resins, polyester resins, polyarylate resins, methacrylic resins, acrylic resins, polyvinyl chloride resins, polyvinylidene chloride resins, polystyrene resins, acrylonitrile-styrene copolymers, acrylonitrile-butadiene copolymers, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride terpolymers, silicone resins, silicone-alkyd resins, phenol-formaldehyde resins, styrene-alkyd resins, poly-N-carbazole, polyvinylbutyral, polyvinylfonnal, polysulfone, casein, gelatin, polyvinyl alcohol, ethylcellulose, phenol resins, polyamide, polyacrylamide, carboxymethylcellulose, vinylidene chloride polymer waxes, and polyurethane; and organic photoconductive polymers such as polyvinyl carbazole, polyvinyl anthracene, polyvinyl pyrene, polysilane, and polyester polymeric charge transport materials described in JP-A Nos. 8-176293 and 8-208820. One of these binder resins is used alone, or two or more of them can be used as a mixture. In particular, the binder resin is preferably a polycarbonate resin, a polyester resin, a methacrylic resin, and/or an acrylic resin, since it has good compatibility with the charge transport material, solubility in a solvent, and strength. The blending ratio (weight ratio) of the binder resin to the charge transport material may be determined, considering deterioration in electrical properties and film strength.

The organic photoconductive polymer may be contained alone in the charge transport layer. The organic photoconductive polymer can be known one having a charge transport property such as poly-N-vinylcarbazole or polysilane. The polyester polymeric charge transport materials described in JP-A Nos. 8-176293 and 8-208820 have a high charge transport property and thus are particularly preferable. The polymeric charge transport material may be contained alone in the charge transport layer 32, but the layer can be made of such a material and the above-described binder resin.

If the charge transport layer 32 is the surface layer of the electrophotographic photoreceptor (one of the layers constituting the photosensitive layer which one is the farthest from the electrically conductive substrate), lubricant particles (for example, silica particles, alumina particles, fluorinated resin particles such as polytetrafluoroethylene (PTFE) particles, and silicone resin fine particles) are preferably added to the charge transport layer 32 to provide the film with lubricity, make the surface layer more resistant to abrasion and scratch, and improve removal of a developer adhered to and remaining on the photoreceptor surface. Two or more types of these lubricant particles may be used as a mixture. The lubricant particles are preferably fluorinated resin particles.

The fluorinated resin particles are preferably made of one or more resins selected from tetrafluoroethylene resins, trifluorochloroethylene resins, hexafluoropropylene resins, vinyl fluoride resins, vinylidene fluoride resins, dichlorodifluoroethylene resins, and copolymers thereof. Among them, the fluorinated resin is more preferably a tetrafluoroethylene resin and/or a vinylidene fluoride resin.

The primary particle diameter of the fluorinated resin particles is preferably about 0.05 to about 1 μm and more preferably about 0.1 to about 0.5 μm. Particles having a primary particle diameter of less than 0.05 μm are more likely to aggregate during or after dispersion. Meanwhile, particles of larger than 1 μm may cause image quality defects more frequently.

The content of the fluorinated resin in the charge transport layer containing the fluorinated resin is suitably about 0.1 to about 40 weight %, and more preferably about 1 to about 30 weight % with respect to the total amount of the charge transport layer. When the fluorinated resin particles are contained at a content of less than 0.1 weight %, the modification effect by dispersion of the fluorinated resin particles becomes insufficient. When the fluorinated resin particles are contained at a content of more than 40 weight % light-transmitting property decreases, and residual electric potential on the resulting electrophotographic photoreceptor increases due to repeated use.

The charge transport layer 32 can be formed by dissolving a charge transporting material, a binder resin, and other materials in a suitable solvent, applying the resultant coating solution for a charge transport layer to the undercoat, intermediate or charge generating layer, and drying the resultant coating.

Examples of the solvent for use in forming the charge transport layer 32 include aromatic hydrocarbon solvents such as toluene and chlorobenzene; aliphatic alcohol solvents such as methanol, ethanol, and n-butanol; ketone solvents such as acetone, cyclohexanone, and 2-butanone; halogenated aliphatic hydrocarbon solvents such as methylene chloride, chloroform, and ethylene chloride; cyclic- or linear ether solvents such as tetrahydrofuran, dioxane, ethylene glycol, and diethyl ether; and mixed solvents thereof. The blending ratio of the charge transport material to the binder resin is preferably 10:1 to 1:5.

In addition, a leveling agent such as silicone oil may be added in a trace amount to the coating solution for a charge transport layer for improvement in smoothness of the resultant coated film.

The fluorinated resin can be dispersed in the charge transport layer 32 with a roll mill, a ball mill, a vibration ball mill, an attritor, a sand mill, a high-pressure homogenizer, an ultrasonic dispersing machine, a colloid mill, a colliding medium-less dispersing machine and/or a penetrating medium-less dispersing machine.

For example, a method of dispersing the fluorinated resin particles in a solution of a binder resin and a charge transport material is employed for dispersion of the particles in the coating solution for a charge transport layer 32.

In the step of producing the coating solution for a charge transport layer 32, the temperature of the coating solution is preferably controlled in the range of about 0° C. to about 50° C.

Various methods including cooling the coating solution with water, air, or a refrigerant, controlling room temperature in the production process, heating the coating solution with hot water, hot air or a heater, and using a facility for producing the coating solution made of a material which hardly generates heat, easily releases heat, or easily accumulates heat may be used for that purpose. It is effective to add a small amount of a dispersion aid for improving stability of the dispersion and preventing aggregation during film formation to the coating solution. Examples of the dispersion aid include fluorochemical surfactants, fluorinated polymers, silicone polymers and silicone oils.

Moreover, it is also effective to disperse, agitate, or mix a fluorinated resin and a dispersion aid in a small amount of a dispersion solvent, agitate the resultant mixture, mix the mixture with a solution in which a charge transport material and a binder resin in a dispersion solvent, and stir the resulting mixture in accordance with the method described above.

Various methods such as dip coating, push-up coating, spray coating, roll coater coating, wire bar coating, gravure coater coating, bead coating, curtain coating, blade coating and air knife coating methods may be used for application of the coating solution for a charge transport layer 32.

The thickness of the charge transport layer 32 is preferably about 5 to about 50 μm and more preferably about 10 to about 45 μm.

The photosensitive layer 3 of the electrophotographic photoreceptor used in the invention may contain any additive such an antioxidant and/or a photostabilizer to prevent the electrophotographic photoreceptor from being damaged by ozone and oxidizing gas generated in an electrophotographic system, light and/or heat.

Examples of the antioxidant include hindered phenols, hindered amines, p-phenylenediamine, arylalkanes, hydroquinone, spirochromane, and spiroindanone, and derivatives thereof, organic sulfur-containing compounds and organic phosphorus-containing compounds.

Specific examples of the phenol antioxidant include 2,6-di-t-butyl-4-methylphenol, styrenated phenols, N-octadecyl-3-(3',5'-di-t-butyl-4'-hydroxyphenyl)propionate, 2,2-methylene-bis-4-methyl-6-t-butylphenol), 2-t-butyl-6-(3'-t-butyl-5'-methyl-2-hydroxybenzyl)-4-methylphenyl acrylate, 4,4'-butylidene-bis-(3-methyl-6-t-butylphenol), 4,4'thio-bis-(3-methyl-6-butylphenol), 1,3,5-tris(4t-butyl-3-hydroxy-2,6-methylbenzyl)isocyanurate, tetrakis-[methylene-3-(3',5'-di-t-butyl-4-hydroxy-phenyl)propionato]-methane, and 3,9,-bis[2-[3-(3-t-butyl-4-hydroxy-5-methylphenyl)propionyloxy]-1,1-dimethylethyl]-2,4,8,10-tetraoxaspiro[5,5]undecane.

Specific examples of the hindered amine compound include bis(2,2,6,6-tetramethyl-4-pyperidyl)sebacate, bis(1,2,2,6,6-pentamethyl-4-pyperidyl)sebacate, 1-[2-[3-3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8benzyl-7,7,9,9-tetramethyl-3-octyl-1,3,8-triazaspiro[4,5]undecan-2,4-dione, 4-benzoyloxy-2,2,6,6-tetramethylpiperidine, dimethyl succinate-1-(2hydroxyethyl)-4-hydroxy-2,2,6,6-tetramethylpiperidine polycondensates, poly[{6-(1,1,3,3-tetramethylbutyl)imino-1,3,5-triazine-2,4-di-imyl}{(2,2,6,6-tetramethyl-4-pyperidyl)imino}hexamethylene{(2,3,6,6,-tetramethyl-4-pyperidyl)imino)]}, bis(1,2,2,6,6-pentamethyl-4-pyperidyl) 2-(3,5-di-t-butyl-4-hydroxybenzyl)-2-butyl malonate, and N,N'-bis(3-aminopropyl)ethylenediamine-2,4-bis[N-butyl-N-1,2,2,6,6-pentamethyl-4pyperidyl)amino]-chloro-1,3,5-triazine condensates.

Specific examples of the organic sulfur-containing antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate),ditridecyl-3,3'-thiodipropionate, and 2-mercaptobenzimidazole.

Specific examples of the organic phosphorus-containing antioxidant include trisnonylphenyl phosphite, triphenyl phosphite, and tris(2,4-di-t-butylphenyl) phosphite.

The organic sulfur- and phosphorus-containing antioxidants are called secondary antioxidants, and such an antioxidant shows synergism when used in combination with the phenol or amine primary antioxidant.

Examples of the photostabilizer include derivatives of benzophenone, benzotriazole, dithiocarbamate, and tetramethyl piperidine.

Examples of the benzophenone photostabilizer include 2hydroxy-4-methoxybenzophenone, 2-hydroxy-4-octoxybenzophenone, and 2,2'-di-hydroxy-4-methoxybenzophenone. Examples of the benzotriazole photostabilizer include 2-(2'-hydroxy-5'-methylphenyl)benzotriazole, 2-[2'-hydroxy-3'-3",4",5",6"-tetra-hydrophthalimido-methyl-)-5'-methylphenyl]-benzotriazole, 2-(2'-hydroxy-3'-t-butyl-5'-methylphenyl-)-5-chlorobenzotriazole, 2-(2'-hydroxy-3',5'-di-t-butylphenyl)benzotriazole, 2-(2'-hydroxy-5'-t-octylphenyl)benzotriazole, and 2-2'-hydroxy-3',5'-di-t-amylphenyl)benzotriazole.

Examples of other photostabilizers include 2,4-di-t-butylphenyl-3',5'-di-t-butyl-4'-hydroxy benzoate, and nickel dibutyl-dithiocarbamate.

The coating solution for a charge transport layer may contain at least one electron-accepting material for improvement in sensitivity, and reduction in residual electric potential and fatigue during repeated use.

Examples of the electron-accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, m-nitrobenzoic acid, and phthalic acid. Among them, the electron-accepting material is preferably a fluorenone compound, a quinone compound and/or a benzene derivative having an electron-attractive substituent such as Cl, CN, or $NO_2$.

A overcoat layer 5 can be used in the electrophotographic photoreceptor 7 having a multi-layer structure to prevent the charge transport layer from chemically changing during charging, improve mechanical strength of the photosensitive layer, and improve resistance of the surface layer of the photoreceptor to abrasion, and scratch.

The overcoat layer 5 can be in the form of a resin-cured film made from a curable resin and or a charge transport compound, or a film made of a suitable binder resin and an electrically conductive material, but is preferably a film containing a charge transport compound. Any known resin may be used as the curable resin, but, from the viewpoints of strength, electrical properties, and/or image quality endurance, is preferably a resin having a crosslinked structure. Examples thereof include phenol resins, urethane resins, melamine resins, diallyl phthalate resins, and siloxane resins.

The overcoat layer 5 is preferably a cured film containing a compound represented by the following Formula (I-1) or (I-2).

$$F\text{-}[D\text{-}Si(R^2)_{(3-a)}Q_a]_b \qquad \text{Formula (I-1)}$$

In Formula (I-1), F represents an organic group derived from an optically functional compound. D represents a flexible subunit. $R^2$ represents a hydrogen atom, an alkyl group, or a substituted or unsubstituted aryl group. Q represents a hydrolyzable group. a is an integer of 1 to 3. b is an integer of 1 to 4.

$$F\text{—}((X)_nR^1\text{-}ZH)_m \qquad \text{Formula (I-2)}$$

In Formula (I-2), F represents an organic group derived from an optically functional compound; $R^1$ represents an alkylene group; Z represents an oxygen atom, a sulfur atom, or a NH, $CO_2$, or COOH group; and m is an integer of 1 to 4. X is an oxygen or sulfur atom; and n is 0 or 1.

In Formulae (I-1) and (I-2), F is a unit having photoelectric properties, specifically photo carrier transport properties, and can be any of structures known as charge transport materials. Typical examples thereof include the skeletons of compounds having a hole transport capacity such as trialkylamine compounds, benzidine compounds, arylalkane compounds, aryl-substituted ethylene compounds, stilbene compounds, anthracene compounds, and hydrazone compounds; and the skeletons of compounds having an electron transport capacity such as quinone compounds, fluorenone compounds, xanthone compounds, benzophenone compounds, cyanovinyl compounds, and ethylene compounds.

In Formula (I-1), $—Si(R^2)_{(3-\alpha)}Q_a$ represents a substituted silicon-containing group having a hydrolyzable group, and the silicone atom of the substituted silicon atom of one molecule and that of other molecules cross-ink with and bind to each other in a cross-linking reaction, forming three-dimensional Si—O—Si bonds. Thus, the substituted silicon-containing group forms a so-called inorganic glass network in the overcoat layer 5.

In Formula (I-1), D represents a flexible subunit, specifically, an organic group connecting the F site that provides a photoelectric property to the substituted silicon group directly bound to the three-dimensional inorganic glass network, providing a suitable flexibility to the inorganic glass network, which is hard but brittle, and improving toughness of a film. Specifically, D is a bivalent hydrocarbon group represented by $—C_nH_{2n}—$, $—C_nH_{(2n-2)}—$, or $—C_nH_{2n-4)}—$ (wherein, n is an integer of 1 to 15); —COO—, —S—, —O—, $—CH_2—C_6H_4—$, —N═CH—, $—(C_6H_4)—(C_6H_4)—$, a functional group having an arbitrary combination of these groups; or one which is the same as the functional group except that the structural atom of the group has been replaced with another substituent.

In Formula (I-1), b is preferably 2 or more. When b is 2 or more, the optically functional organic silicon compound represented by Formula (I-1) contains two or more Si atoms and thus forms the inorganic glass network more easily, improving mechanical strength of the resulting film.

The compound represented by Formulae (I-1) or (I-2) is particularly preferably a compound having an organic group F represented by the following (I-3). The compound represented by Formula (I-3) has a hole transport ability (hole transport material), and the overcoat layer 5 preferably contains the compound from the viewpoints of improvement in photoelectric and mechanical properties of the overcoat layer 5.

Formula (I-3)

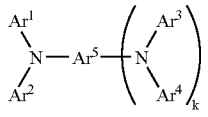

In Formula (I-3), $Ar^1$ to $Ar^4$ each independently represent a substituted or unsubstituted aryl group, and k represents 0 or 1.

$Ar^5$ represents a substituted or unsubstituted aryl group or an arylene group. However, two to four groups of $Ar^1$ to $Ar^5$ have a binding site represented by $-D-Si(R^2)_{(3-\alpha)}Q_a$ or —((X)$nR_1$-ZH)m. D represents a flexible subunit. $R^2$ represents a hydrogen atom, an alkyl group, or a substituted or unsubstituted aryl group. Q represents a hydrolyzable group; and a is an integer of 1 to 3. $R_1$ represents an alkylene group; Z represents an oxygen atom, a sulfur atom, NH, $CO_2$, or COOH; and m is an integer of 1 to 4. X is an oxygen or sulfur atom; and n is 0 or 1.

$Ar^1$ to $Ar^5$ in Formula (I-3) each are preferably a group represented by any one of the following Formula (I-4) to (I-10) shown in Table 1.

TABLE 1

| | |
|---|---|
| (I-4) | 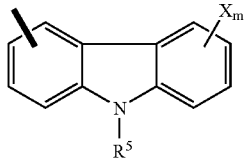 |
| (I-5) | 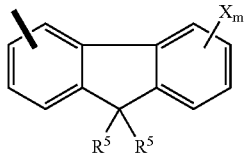 |
| (I-6) | 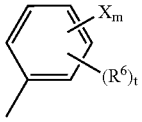 |
| (I-7) | 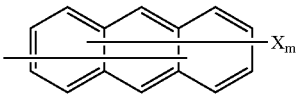 |
| (I-8) | 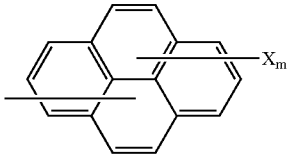 |
| (I-9) | 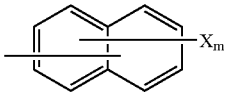 |
| (I-10) | $—Ar—(Z')_s—Ar—X_m$ |

In Formulae (I-4) to (I-10), each $R^5$ represents one selected from the group consisting of a hydrogen atom, an alkyl group having 1 to 4 carbon atoms, a phenyl group substituted with an alkyl group having 1 to 4 carbon atoms or with an alkoxy group having 1 to 4 carbon atoms, an unsubstituted phenyl group, and an aralkyl group having 7 to 10 carbon atoms. $R^6$ represents one selected from the group consisting of a hydrogen atom, an alkyl group having 1 to 4 carbon atoms, an alkoxy group having 1 to 4 carbon atoms, and a halogen atom. X represents a functional group having the structures represented by Formula (I-3); m and s each are 0 or 1; and t is an integer of 1 to 3.

In Formula (I-10), Ar is preferably a group represented by the following Formula (I-11) or (I-12) shown in Table 2.

TABLE 2

| | |
|---|---|
| (I-11) | 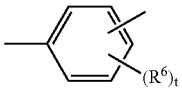 |

TABLE 2-continued

| | |
|---|---|
| (I-12) | 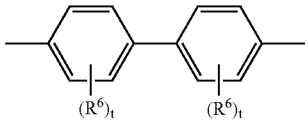 |

In Formulae (I-11) and (I-12), $R^6$ has the same meanings as those of $R^6$ in Formulae (I-6), and t is an integer of 1 to 3.

Z' in Formula (I-10) is preferably a group represented by the following Formula (I-13) or (I-14).

As described above, in Formulae (I-4) to (I-10), X represents a functional group having a structure represented by Formula (I-3). D in the functional group represents a bivalent hydrocarbon group represented by $—C_lH_{2l}—$, $—C_mH_{2m-2}—$, or $—C_nH_{2n-4}—$ described above (wherein, 1 is an integer of 3 to 15; m is an integer of 2 to 15; and n is an integer of 3 to 15), —N; =CH—, —O—, —COO—, —S—, $—(CH)_\beta—$ (β is an integer of 1 to 10), a functional group represented by Formula (I-11) or (I-12) described above or the following Formula (I-13) or (I-14) shown in Table 3.

TABLE 3

| | |
|---|---|
| (I-13) | 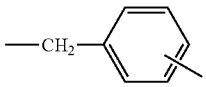 |
| (I-14) | 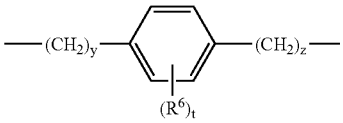 |

In Formula (I-14), y and z each are an integer of 1 to 5; t is an integer of 1 to 3. As described above, $R^6$ is one selected from the group consisting of a hydrogen atom, an alkyl group having 1 to 4 carbon atoms, an alkoxy group having 1 to 4 carbon atoms, and a halogen atom.

In Formula (I-3), $Ar^5$ represents a substituted or unsubstituted aryl group or an arylene group, which, when k is 0, is preferably a compound represented by any one of the following Formulae (I-15) to (I-19) shown in Table 4 and, when k is 1, a group represented by any one of the following Formulae (I-20) to (I-24) shown in Table 5.

TABLE 4

| | |
|---|---|
| (I-15) | 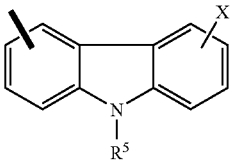 |
| (I-16) | 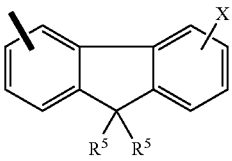 |

TABLE 4-continued

| | |
|---|---|
| (I-17) | 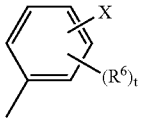 |
| (I-18) | 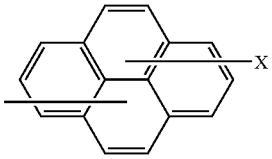 |
| (I-19) | $—Ar—(Z)_s—Ar—X$ |

TABLE 5

| | |
|---|---|
| (I-20) | 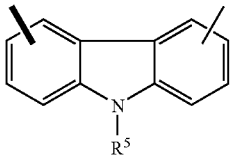 |
| (I-21) | 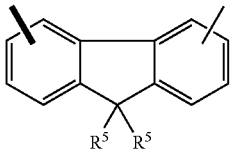 |
| (I-22) | 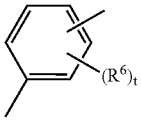 |
| (I-23) | 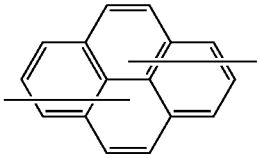 |
| (I-24) | $—Ar—(Z)_s—Ar—$ |

In Formulae (I-15) to (I-24), each $R^5$ independently represents one selected from the group consisting of a hydrogen atom, an alkyl group having 1 to 4 carbon atoms, a phenyl group substituted with an alkyl group having 1 to 4 carbon atoms or with an alkoxy group having 1 to 4 carbon atoms, an unsubstituted phenyl group, and an aralkyl group having 7 to 10 carbon atoms. $R^6$ represents one selected from the group consisting of a hydrogen atom, an alkyl group having 1 to 4 carbon atoms, an alkoxy group having 1 to 4 carbon atoms, and a halogen atom. s is 0 or 1; and t is an integer of 1 to 3. Z and X each have the same meanings as those in Formula (I-2).

When $Ar^5$ in Formula (I-2) has one of the structures represented by Formulae (I-15) to (I-19) or Formulae (I-20) to (I-24), Z in Formulae (I-19) and (I-24) is preferably a group selected from the group consisting of groups represented by the following Formulae (I-25) to (I-32) shown in Table 6.

TABLE 6

| | |
|---|---|
| (I-25) | $—(CH_2)_q—$ |
| (I-26) | $—(CH_2CH_2O)_r—$ |
| (I-27) | |
| (I-28) | |
| (I-29) | |
| (I-30) | |
| (I-31) | |
| (I-32) | |

In Formulae (I-25) to (I-32), each $R^7$ is one selected from the group consisting of a hydrogen atom, an alkyl group having 1 to 4 carbon atoms, an alkoxy group having 1 to 4 carbon atoms, and a halogen atom; W represents a bivalent group; q and r each are an integer of 1 to 10; and t' is an integer of 1 to 2.

W in Formulae (I-31) and (I-32) is preferably one of the bivalent groups represented by the following Formulae (I-33) to (I-41) shown in Table 7. In Formula (I-40), s' is an integer of 0 to 3.

$—CH_2—$ (I-33)

$—C(CH_3)_2—$ (I-34)

—O— (I-35)

—S— (I-36)

$—C(CF_3)_2—$ (I-37)

$—Si(CH_3)_2—$ (I-38)

TABLE 7

| | |
|---|---|
| (I-39) | |
| (I-40) | |

TABLE 7-continued

| | |
|---|---|
| (I-41) | |

Typical examples of the compound represented by Formula (I-3) include compounds Nos. 1 to 274 described in Tables 1 to 55 of JP-A 2001-83728.

One of the charge transport compounds represented by Formula (I-1) may be used alone, or two or more of them can be used together.

A compound represented by the following Formula (II) may be used together with the charge transport compound represented by Formula (I-1) to improve mechanical strength of the cured film.

$$B—(Si(R^2)_{(3-\alpha)}Q_a)_2 \quad \text{Formula (II)}$$

In Formula (II), B represents a bivalent organic group; $R^2$ represents a hydrogen atom, an alkyl group, or a substituted or unsubstituted aryl group; Q represents a hydrolyzable group; and a is an integer of 1 to 3.

The compound represented by Formula (II) is preferably a compound represented by any one of the following Formulae (II-1) to (II-5) shown in Table 8. However, the invention is not restricted to these examples.

In Formulae (II-1) to (II-5), $T^1$ and $T^2$ each independently represent a bivalent or trivalent hydrocarbon group which may be branched. A represents a substituted hydrolyzable silicon-containing group described above. h, i, and j each independently are an integer of 1 to 3. In addition, the compound represented by Formula (II-1) to (II-5) is selected so that the number of groups A in the molecule becomes two or more.

TABLE 8

| | |
|---|---|
| (II-1) | $T^1$—$A]_j$ |
| (II-2) | |
| (II-3) | |
| (II-4) | $HN$—$T^1$—$A]_2$ |
| (II-5) | |

Hereinafter, typical examples of the compound represented by Formula (II), i.e., compound represented by the following Formulae (III-1) to (III-19), are summarized in Tables 9 and 10. In Tables 9 and 10, Me represents a methyl group; Et represents an ethyl group; and Pr represents a propyl group.

TABLE 9

| | |
|---|---|
| (III-1) | $(MeO)_3Si$ — $Si(OMe)_3$ |
| (III-2) | $(EtO)_3Si$ — $Si(OEt)_3$ |
| (III-3) | $(i\text{-}Pr—O)_3Si$ — $Si(O—i\text{-}Pr)_3$ |
| (III-4) | $(MeO)_3Si$ — $Si(OMe)_3$ |
| (III-5) | $(EtO)_3Si$ — $Si(OEt)_3$ |
| (III-6) | $(i\text{-}Pr—O)_3Si$ — $Si(O—i\text{-}Pr)_3$ |
| (III-7) | $(MeO)_3Si$ — $Si(OMe)_3$ |
| (III-8) | $(EtO)_3Si$ — $Si(OEt)_3$ |
| (III-9) | $(MeO)_3Si$ — $Si(OMe)_3$ |
| (III-10) | $(EtO)_3Si$ — $Si(OEt)_3$ |
| (III-11) | $(MeO)_3Si$ — H N — $Si(OMe)_3$ |
| (III-12) | $(MeO)_3Si$ — H N — N H — $Si(OMe)_3$ |

| | |
|---|---|
| (III-13) | $(MeO)_2MeSi(CH_2)_2SiMe(OMe)_2$ |
| (III-14) | $(EtO)_2EtSi(CH_2)_2SiEt(OEt)_2$ |
| (III-15) | $(MeO)_2MeSi(CH_2)_6SiMe(OMe)_2$ |
| (III-16) | $(EtO)_2EtSi(CH_2)_6SiEt(OEt)_2$ |
| (III-17) | $(MeO)_2MeSi(CH_2)_{10}SiMe(OMe)_2$ |
| (III-18) | $(EtO)_2EtSi(CH_2)_{10}SiEt(OEt)_2$ |
| (III-19) | $(MeOMe_2Si(CH_2)_6SiMe_2OMe$ |

A cross-linkable other compound may be used together with the compound represented by Formula (I). Examples of such a compound include various silane coupling agents and commercially available silicon hard-coating agents.

Typical examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β(aminoethyl)γ-aminopropyltriethoxylsilane, tetramethoxysilane, methyltrimethoxysilane, and dimethyldimethoxysilane.

Examples of the commercially available hard-coating agent include KP-85, CR-39, X-12-2208, X-40-9740, X-41-1007, KNS-5300, and X-40-2239 (manufactured by Shin-Etsu Chemical Co., Ltd); and AY42-440, AY42-441, and AY49-208 (manufactured by Dow Corning Toray Silicone Co., Ltd.).

In addition, the overcoat layer 5 may contain a fluorine-containing compound to improve surface lubricity thereof. Improvement in surface lubricity leads to a decrease in the frictional coefficient with respect to a cleaning member and improvement in abrasion resistance of the overcoat layer. It is also effective in preventing adhesion of discharge products, developer and paper powder onto the electrophotographic photoreceptor surface and elongating the life of the electrophotographic photoreceptor 7.

The fluorine-containing compound can be a fluorine-containing polymer such as polytetrafluoroethylene. The polymer can be contained as it is or as fine particles.

When the overcoat layer 5 is a cured film made from a compound represented by Formula (I), it is preferable that the fluorine-containing compound can react with an alkoxysilane and is incorporated as a part of the cross linked film.

Typical examples of the fluorine-containing compound include (tridecafluoro-1,1,2,2-tetrahydrooctyl)triethoxylsilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane.

The amount of the fluorine-containing compound contained is preferably 20 weight % or less. A higher content may leads to problems in forming the cross4inked film.

Although the overcoat layer 5 has sufficient oxidation resistance, the layer may contain an antioxidant to enhance the oxidation resistance.

The antioxidant is preferably a hindered phenol or a hindered amine, but can also be a known antioxidant such as an organic sulfur-containing antioxidant, a phosphite antioxidant, a dithiocarbarmic acid salt antioxidant, a thiourea antioxidant, and/or a benzimidazole antioxidant. The amount of the antioxidant added is preferably 15 weight % or less and more preferably 10 weight % or less.

Examples of the hindered phenol antioxidant include 2,6-di-t-butyl-4-methylphenol, 2,5-di-t-butylhydroquinone, N,N'-hexamethylene bis(3,5-di-t-butyl-4-hydroxy)hydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylene bis(4methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidene bis(3-methyl-6-t-butyl phenol).

The overcoat layer 5 may also contain other known additives used in film coating such as a leveling agent, an ultraviolet absorbent, a photostabilizer, and/or a surfactant.

In order to form the overcoat layer 5, a mixture of the various materials and additives described above is applied onto a photosensitive layer and the coated layer is heated. The heating causes a three-dimensionally cross-linking curing reaction, forming a stiff cured film. The heating temperature is not particularly limited, as long as it does not affect the photosensitive layer, which is provided under the overcoat layer 5. However, the temperature is preferably in the range from room temperature to about 200° C. and more preferably in the range of about 100 to about 160° C.

If the overcoat layer 5 is cross-linked, the reaction may be carried out in the presence or absence of a catalyst. Examples of the catalyst include acids such as hydrochloric acid, sulfuric acid, phosphoric acid, formic acid, acetic acid, and trifluoroacetic acid; bases such as ammonia and triethylamine; organic tin compounds such as dibutyltin diacetate, dibutyltin dioctoate, and stannous octoate; organic titanium compounds such as tetra-n-butyl titanate, and tetraisopropyl titanate; iron salts, manganese salts, cobalt salts, zinc salts, and zirconium salts of organic carboxylic acids; and aluminum chelate compounds.

A coating solution for a overcoat layer 5 may contain a solvent 5 to facilitate coating, if necessary. Specific examples of the solvent include water, and ordinary organic solvents such as methanol, ethanol, n-propanol, isopropanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, dimethyl ether, and dibutyl ether. One of these solvents may be used alone, or two or more of them can be used together.

In forming the overcoat layer 5, any of ordinary methods such as blade coating, wire bar coating, spray coating, dip coating, bead coating, air knife coating, or curtain coating methods may be used.

The thickness of the overcoat layer 5 is preferably about 0.5 to about 20 μm and more preferably about 2 to about 10 μm.

To obtain the electrophotographic photoreceptor 1-1 with higher resolution, the thickness of a functional layer which is disposed on or over the charge generating layer 31 is preferably about 50 μm or less and more preferably about 40 μm or less. Combined use of the particle-dispersed undercoat layer used in the invention and a highly strong overcoat layer 5 is particularly effective when the functional layer is thin.

The electrophotographic photoreceptor 1-1 is not limited to the above-described configuration. For example, the electrophotographic photoreceptor 1-1 may have a configuration without an intermediate layer 4 and/or a overcoat layer 5. Thus, the photoreceptor may have a configuration in which an undercoat layer 2 and a photosensitive layer 3 are formed on an electrically conductive substrate 1; a configuration in which an undercoat layer 2, an intermediate layer 4, and a photosensitive layer 3 are formed in that order on an electrically conductive substrate 1; or a configuration in which an undercoat layer 2, a photosensitive layer 3, and a overcoat layer 5 are formed in that order on an electrically conductive substrate 1.

In addition, the charge generating layer 31 can be disposed under or on the charge transport layer 32. Further, the photosensitive layer 3 may have a single layer structure. In such a case, the photoreceptor may have a overcoat layer on the photosensitive layer, or may have both an undercoat layer and a overcoat layer. In addition, an intermediate layer may be formed on the undercoat layer as described above. When the photosensitive layer has a single layer structure, the photosensitive layer is formed, for example, by applying a binder resin containing a charge generating material, a charge transport material, or the two materials. Examples of these materials are the same as those described in the explanations for a layer having a multi-layer structure.

Hereinafter, the charging unit will be described. Any of known members including a non-contact-type member such as Corotron and Scorotron and contact-type charging members such as a charging roll, a charging brush, a charging film or a charging tube may be used as the charging unit of the image-forming apparatus according to the invention. The charging unit 1-3 of the device shown in FIG. 1 is a contact-type charging device.

In a contact-type charging process, the photoreceptor surface is electrically charged by applying a voltage to an electrically conductive member that is in contact with the photoreceptor surface. The electrically conductive member may be in the shape of a brush, a blade, a pin electrode or a roller, but is preferably a roller-shaped member. The roller-shaped member usually has a structure composed, from the outside of the member to the inside, of a resistance layer, and an elastic layer and a core material which support the resistance layer. A overcoat layer may be formed on the resistance layer, if necessary.

As described above, the roller-shaped member is in contact with the photoreceptor. Therefore, it rotates at the same peripheral velocity as that of the photoreceptor without a driving unit, and functions as a charging unit. However, the roller-shaped member may be connected to a driving unit, may rotate at a peripheral velocity different from that of the photoreceptor, and may charge the photoreceptor. An electrically conductive material is usually used as the core material, and typical examples thereof include iron, copper, brass, stainless steel, aluminum and nickel. Alternatively, a molded article made of a resin and containing electrically conductive particles may also be used as the core material. The elastic layer is made of an electrically conductive or semiconductive material and typical examples thereof include rubbers containing electrically conductive or semiconductive particles dispersed therein. Examples of the rubber include EPDM, polybutadiene, natural rubber, polyisobutylene, SBR, CR, NBR, silicone rubber, urethane rubber, epichlorohydrin rubber, SBS, thermoplastic elastomer, norbornene rubber, fluorosilicone rubber and ethylene oxide rubber. Examples of the material of the electrically conductive or semiconductive particles include carbon black; metals such as zinc, aluminum, copper, iron, nickel, chromium, and titanium; and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO. One of these materials may be used alone, or two or more of them can be used as a mixture. A binder resin, in which the electrically conductive or semiconductive particles are dispersed, is used to control a resistivity of each of the resistance and overcoat layers, and the resistivity is usually about $10^3$ to about $10^{14}$ Ωcm, preferably about $10^5$ to about $10^{12}$ Ωcm, and more preferably about $10^7$ to about $10^{12}$ Ωcm. The thickness of each of the resistance and overcoat layers is about 0.01 to about 1000 μm, preferably about 0.1 to about 500 μm, and more preferably about 0.5 to about 100 μm. Examples of the binder resin used in these layers include acrylic resins, cellulose resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins such as PFA, FEP, and PET, and styrene-butadiene resins. As in the resistance layer, the overcoat layer may contain, as the electrically conductive or semiconductive particles, those of carbon black, a metal, or a metal oxide. In addition, the overcoat layer may contain an antioxidant such as a hindered phenol or a hindered amine, a filler such as clay or kaolin, and a lubricant such as a silicone oil, if necessary. These layers can be formed by such a coating method as a blade coating method, a wire bar coating method, a spray coating method, a dip coating method, a bead coating method, an air knife coating method and/or a curtain coating method.

In electrically charging the photoreceptor, a voltage is applied thereto with an electrically conductive member, and the voltage applied is preferably a DC voltage or a voltage obtained by superimposing a DC voltage and an AC voltage. The value of the DC voltage depends on a desired charge potential of the photoreceptor. The DC voltage is preferably in the range of about 50 to about 2,000 V or in the range of about −50 to about −2,000V. It is more preferably in the range of about 100 to about 1,500 V, or in the range of about −100 to about −1,500 V. When an AC voltage is superimposed on the DC voltage, the voltage between peaks is generally about −400 to about −1,800 V, preferably about −800 to about −1,600 V, and more preferably about −1,200 to about −1,600 V. The frequency of the AC voltage is generally about 50 to about 20,000 Hz and preferably about 100 to about 5,000 Hz.

The exposure unit can be an optical device that imagewise irradiates the surface of the photoreceptor 1-1 with a light source such as a semiconductor laser, a light emitting diode (LED), or a liquid crystal shutter. Use of an exposure device that is capable of emitting an incoherent beam eliminates interference fringes between the electrically conductive substrate and the photosensitive layer of the electrophotographic photoreceptor 1-1.

Any one of known developing devices employing a normal or reverse one- or two-component developer may be used as the developing device 1-2. The shape of the toner used is not particularly limited, but is preferably sphere from the viewpoints of image quality and ecology. The spherical toner is one having an average shape factor (SF1) in the range of about 100 to about 150, and preferably about 100 to about 140 to attain high transfer efficiency. Toners having an average shape factor SF1 of more than 140 have decreased transfer efficiency, leading to visually observable deterioration in image quality of print samples.

A spherical toner contains at least a binder resin and a coloring agent. The spherical toner is preferably particles having a diameter of about 2 to about 12 μm and more preferably those having a diameter of about 3 to about 9 μm.

Examples of the binder resin include homopolymers and copolymers of styrenes, monoolefins, vinylesters, α-methylene aliphatic monocarboxylic acid esters, vinylethers, and vinylketones. Specific examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. The binder resin can also be polyester, polyurethane, epoxy resin, silicone resin, polyamide, modified rosin and/or paraffin wax.

Typical examples of the coloring agent include magnetic powders such as magnetite and ferrite, carbon black, aniline blue, Calco oil blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Known additives such as a charge control agent, a releasing agent, and other inorganic fine particles may be added internally or externally to the spherical toner.

Typical examples of the releasing agent include low-molecular weight polyethylene, low-molecular weight polypropylene, Fischer-Tropsch wax, montan wax, carnauba wax, rice wax and candelilla wax.

Any known charge control agent may be used, but is preferably an azo metal complex compound, a metal complex compound of salicylic acid, or a resin-type charge control agent containing a polar group.

Other inorganic fine particles are used for control of powder flowability and charge, and preferably small-diameter inorganic fine particles having an average primary particle diameter of 40 nm or less. They can be used together with large-diameter inorganic or organic fine particles for reduction of adhesion. These other inorganic fine particles are chosen from known inorganic fine particles.

Surface treatment of the small-diameter inorganic fine particles is effective in increasing dispersion property thereof and powder flowability.

The method of producing the spherical toner is not particularly limited and any known method may be employed as such. Specifically, the toner may be produced, for example, in accordance with a kneading-pulverizing method, a method for changing the shape of particles obtained in accordance with the kneading-pulverizing method by applying mechanical impulsive force or thermal energy thereto, an emulsion-polymerization flocculation method, or a dissolution suspension method. Alternatively, a toner having a core-shell structure may be produced by using the spherical toner obtained by the method described above as a core, attaching aggregated particles to the core and thermally heating the resultant. If an external additive is added to toner mother particles, a toner can be produced by mixing a spherical toner and the external additive with a Henschel Mixer or a V blender. If a spherical toner is produced in a wet manner, the external additive may be added to the toner mother particles in the liquid system.

Further, the intermediate transfer member 1-8 can be made of any known electrically conductive thermoplastic resin. Examples thereof the electrically conductive thermoplastic resins include polyimide resins, polycarbonate resins (PC), polyvinylidene fluoride (PVDF), polyalkylene terephthalates (PAT), blend materials including ethylene tetrafluoroethylene copolymer (ETFE)/PC, ETFE/PAT, and PC/PAT, which contain an electrically conductive material. Among them, use of a polyimide resin containing a dispersed electrically conductive material is preferable because the resin provides an intermediate transfer body with superior mechanical strength.

Examples of the electrically conductive material include carbon black, metal oxides, and electrically conductive polymers such as polyaniline.

If the intermediate transfer body 1-8 is a belt, the thickness thereof is preferably about 50 to about 500 μm and more preferably about 60 to about 150 μm, but may be selected suitably according to hardness of the material.

As described in JP-A No. 63-311263, a polyimide resin belt containing a dispersed electrically conductive material can be produced by dispersing about 5 to about 20 weight % of carbon black serving as an electrically conductive material in a solution of polyimide precursor (polyamide acid), supplying the dispersion to a metal drum, spreading the dispersion thereon, drying the resultant, releasing the resultant film from the drum, drawing the film at a high temperature to form a polyimide film, and cutting the resulting film into the form of an endless belt of suitable size. Generally, the film is formed by injecting a polyamide acid stock solution for film formation containing a dispersed electrically conductive material into a cylindrical mold, rotating the mold (subjecting the solution to centrifugation) to form a film, for example, at a temperature of about 100 to about 200° C. at a rotating speed of about 500 to about 2,000 rpm, removing the film which has been half-hardened from the mold, placing it around an iron core, and progressing a reaction of converting it into polyimide (cyclization reaction of polyamide acid) at a high temperature of 300° C. or more to completely harden the film. Alternatively, the polyimide film may be prepared by supplying the stock solution for film formation to a metal sheet and spreading the solution thereon to form a layer having a uniform thickness, heating the layer at a temperature in the range of about 100 to about 200° C. similarly to the above-described method to remove most of the solvent, and raising the temperature stepwise to a high temperature of 300° C. or more.

The intermediate transfer member 1-8 may have a surface layer.

The cleaning unit 1-6 removes the toner remaining on the surface of the electrophotographic photoreceptor 1-1 after the transfer step, and the electrophotographic photoreceptor 1-1 whose surface has been cleaned by the cleaning device is used again in the image-forming method described above for repeated use. The cleaning device 1-6 shown in FIG. 1 is a cleaning blade, but may be a brush or a roll. The cleaning device is preferably a cleaning blade. The cleaning blade is, for example, made of urethane rubber, neoprene rubber or silicone rubber.

The electrophotographic device according to the invention may also have a charge-eliminating device such as an erasing beam irradiation device. When the electrophotographic photoreceptor is used repeatedly, the charge-eliminating device prevents residual electric potential on the electrophotographic photoreceptor being brought into the next image-forming cycle, and further improves image quality.

Although an example of a tandem color image-forming device is shown in FIG. 1, the image-forming device according to the invention may be a device equipped with only one image-forming unit such as a monochromic image-forming device or a color image-forming device equipped with a rotary developing device (also called a rotary developing machine). The rotary developing device has plural developing units that rotate and move, and makes at least one developing unit use of which is needed in a printing face the photoreceptor to form at least one toner image having a desirable color on the photoreceptor one by one.

Figure 3:
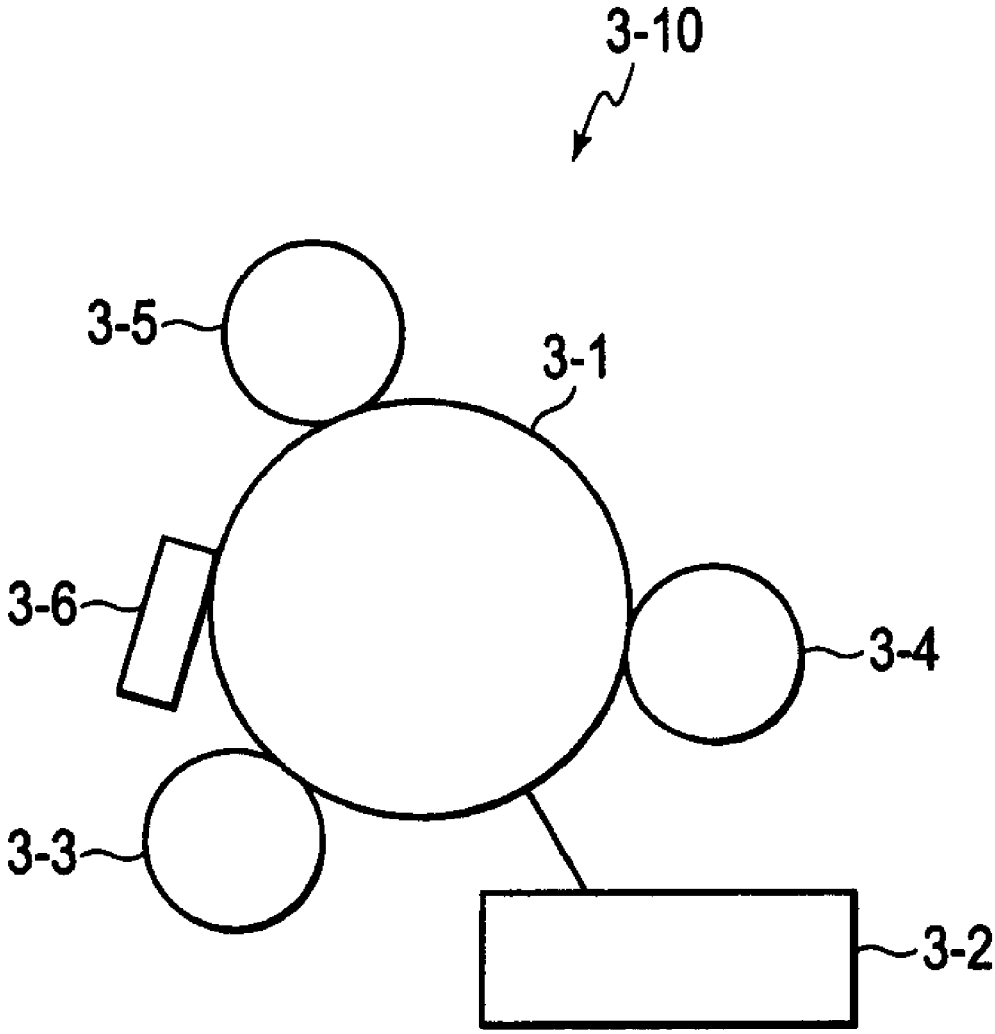
FIG. 3 is a schematic view illustrating a configuration of an embodiment of a process cartridge according to the present disclosure.

Alternatively, as shown in FIG. 3, a process cartridge (3-10) detachable from an image-forming device in which process cartridge (3-10), a photoreceptor (3-1) and at least one device selected from a charging device (3-3), a developing device (3-4), a transfer device (3-5) and a cleaning device (3-6) are integrated may be used in the invention. In such a case, the photoreceptor (3-10) can be connected to a driving unit to control the traveling speed of the peripheral surface of the photoreceptor (3-1) and thereby make the period from charging to development variable. The process cartridge (3-10) according to the invention contains a controller (3-2) (such as a driving device) that controls the peripheral surface of the photoreceptor (3-1), but the controller (3-2) may be separated from the process cartridge (3-10) and installed in the image-forming device according to the invention.

EXAMPLES

Hereinafter, the invention will be described in more detail with reference to examples and comparative examples, but it should be understood that the invention is not restricted by these examples at all.

Example 1

1.25 parts by weight of a silane coupling agent (KBM603 manufactured by Shin-Etsu Chemical) is added to an agitated mixture of 100 parts by weight of zinc oxide manufactured by Tayca Corporation and having an average primary particle diameter of 70 nm and a specific surface area of 15 $m^2/g$ and 500 parts by weight of tetrahydrofuran. The resultant mixture is agitated for two hours. Then, tetrahydrofuran is distilled off under a reduced pressure, the residue is baked at 120° C. for three hours to obtain a zinc oxide pigment surface-treated with the silane coupling agent.

A solution in which 1.0 part by weight of alizarin is dissolved in 10 parts by weight tetrahydrofuran is added to an agitated mixture of 100 parts by weight of the surface-treated zinc oxide and 500 parts by weight of tetrahydrofuran. The resultant mixture is agitated at 50° C. for five hours. Then, the mixture is filtered under a reduced pressure to collect alizarin-added zinc oxide and the zinc oxide is dried at 60° C. under a reduced pressure to obtain an alizarin-added zinc oxide pigment.

60 parts by weight of the alizarin-added zinc oxide pigment, 13.5 parts by weight of a hardening agent, blocked isocyanate (SUMIDUR 3175 manufactured by Sumitomno Bayer Urethane Co.), 38 parts by weight of a solution in which 15 parts by weight of butyral resin (BM-1 manufactured by Sekisui Chemical Co.) is dissolved in 85 parts by weight of methyl ethyl ketone, and 25 parts by weight of methyl ethyl ketone are mixed, and the resultant mixture is stirred with a sand mill containing glass beads with a diameter of 1 mm for two hours to obtain a liquid dispersion. 0.005 part by weight of dioctyltin dilalurate serving as a catalyst and 4.0 parts by weight of silicone resin particles (TOSPEARL 145 manufactured by GE Toshiba Silicones) are added to the liquid dispersion so as to obtain a coating solution for an undercoat layer. The coating solution is applied to an aluminum substrate having a diameter of 30 mm, a length of 404 mm, and a thickness of 1 mm in accordance with a dip coating method and the resultant coating is dried and hardened at 170° C. for 40 minutes to form an undercoat layer having a thickness of 25 μm.

Then, a photosensitive layer is formed on the undercoat layer. First, a mixture of 15 parts by weight of a charge generating material, hydroxygallium phthalocyanine having diffraction peaks at least at Bragg angles (2θ±0.2°) of 7.3°, 16.0°, 24.9°, and 28.0° as determined by an X-ray diffraction spectrum obtained by using a Cukα ray, 10 part by weight of a binder resin, a vinyl chloride-vinyl acetate copolymer resin (VMCH manufactured by Nippon Unicar Co., Ltd.), and 200 parts by weight of n-butyl acetate is stirred with a sand mill containing glass beads with a diameter of 1 mm for four hours. 175 parts by weight of n-butyl acetate and 180 parts by weight of methyl ethyl ketone arc added to the resultant dispersion, and the resultant mixture is agitated to obtain a coating solution for a charge generating layer. The coating solution for a charge generating layer is applied to the undercoat layer in accordance with dip coating, and the resultant coating is dried at room temperature to form a charge generating layer having a thickness of 0.2 μm.

Subsequently, 1 part by weight of tetrafluoroethylene resin particles, 0.02 part by weight of a fluorinated graft polymer, 5 parts by weight of tetrahydrofuran, and 2 parts by weight of toluene are mixed well to obtain a tetrafluoroethylene resin particle suspension. Then, 4 parts by weight of a charge transport material, N,N'-diphenyl-N,N'-bis(3-methylphenyl)-[1,1']-biphenyl-4,4'-diamine, and 6 parts by weight of a bisphenol Z-type polycarbonate resin (viscosity-average molecular weight: 40,000) are mixed with and dissolved in 23 parts by weight of tetrahydrofuran and 10 parts by weight of toluene. The fluoroethylene resin particle suspension is added to the resultant solution, and the resultant mixture is agitated. Then, the mixture is agitated repeatedly six times at a raised pressure of 400 $kgf/cm^2$ with a high-pressure homogenizer (LA-33S manufactured by Nanomizer Co., Ltd.) equipped with a penetration chamber having narrow flow channels to obtain a tetrafluoroethylene resin particle dispersion. Further, 0.2 part by weight of 2,6-di-t-butyl-4-methylphenol is added to the dispersion, and the resultant mixture is agitated to obtain a coating solution for a charge transport layer. The coating solution is applied to the charge generating layer, and the resultant coating is dried at 115° C. for 40 minutes to form a charge transport layer having a thickness of 32 μm. Thus, an electrophotographic photoreceptor is obtained.

The electrophotographic photoreceptor is loaded in a modified full-color printer DOCUCENTRE COLOR 400 manufactured by Fuji Xerox Co., Ltd., and having a contact-type charging device and an intermediate transfer device. Test prints are carried out at a charge potential of −700V in a low-speed mode, in which the period from charging to development is 300 msec, a normal mode, in which the period is 200 msec, and a high-speed mode, in which the period is 100 msec. Results obtained by these tests are summarized in Table 10.

Examples 2 to 4

Electrophotographic photoreceptors are prepared in the same manner as in Example 1, except that the acceptor compound added to zinc oxide surface-treated with the silane coupling agent in Example 1 is replaced with each of materials shown in Table 11. Results are summarized in Table 11.

Comparative Example 1

An electrophotographic photoreceptor is prepared in the same manner as in Example 1, except that an acceptor compound is not added to zinc oxide surface-treated with a silane coupling agent. Results are summarized in Table 11.

TABLE 11

| | Acceptor compound | Image quality defect | Time which processes from charging to development take: Low-speed mode 300 msec | Normal mode 200 msec | High-speed mode 100 msec |
|---|---|---|---|---|---|
| Example 1 | Alizarin | Fogging | None | None | None |
| | | Black spot | None | None | None |
| | | Image memory | None | None | None |
| Example 2 | 1-Hydroxyanthraquinone | Fogging | Little | None | None |
| | | Black spot | Few | None | None |
| | | Image memory | None | None | None |
| Example 3 | Purpurin | Fogging | Little | None | None |
| | | Black spot | Few | None | None |
| | | Image memory | None | None | None |
| Example 4 | 2-Amino-3-hydroxyanthraquinone | Fogging | Little | None | None |
| | | Black spot | Few | None | None |
| | | Image memory | None | None | None |
| Comparative Example 1 | — | Fogging | Remarkable | Some | None |
| | | Black spot | Remarkable | Some | None |
| | | Image memory | Remarkable | Remarkable | Some |

What is claimed is:

1. An image-forming apparatus, comprising an electrophotographic photoreceptor, a charging unit, a light-exposure unit, a development unit, a transfer unit, and a controller that controls the traveling speed of the peripheral surface of the electrophotographic photoreceptor and thus makes a period from charging to development variable, wherein:

the electrophotographic photoreceptor comprises an undercoat layer and a photosensitive layer; and the undercoat layer contains metal oxide fine particles with an acceptor compound added on the metal oxide fine particles in a content of about 0.01% to about 20% by weight and wherein the metal oxide fine particles with the acceptor compound added thereon are dispersed in a resin; and an image is formed by charging, light exposure, development and transfer while causing the peripheral surface of the electrophotographic photoreceptor to travel in a predetermined direction, wherein:

the acceptor compound is one or more compounds selected from monohydroxyanthraquinone and aminohydroxyanthraquinone.

2. The image-forming apparatus of claim 1, wherein the controller controls the traveling speed of the peripheral surface of the electrophotographic photoreceptor such that operation is switchable between a plurality of control modes including a normal mode, a low-speed mode and a high-speed mode.

3. The image-forming apparatus of claim 1, wherein the metal oxide fine particles are surface-treated with a coupling agent before addition of the acceptor compound.

4. The image-forming apparatus of claim 1, wherein the metal oxide fine particles contain one or more kinds selected from titanium oxide, zinc oxide, tin oxide, and zirconium oxide particles.

5. The image-forming apparatus of claim 1, wherein the charging unit is a contact-type charging device that is brought into contact with the electrophotographic photoreceptor to charge the electrophotographic photoreceptor.

6. The image forming apparatus of claim 1, wherein the undercoat layer further contains electron transport materials selected from a group consisting of quinone compounds; tetracyanoquinodimethane compounds; fluorenone; oxadiazole compounds; xanthone compounds; thiophene compounds; diphenoquinone compounds; electron transport pigments; zirconium chelate compounds; titanium chelate compounds; aluminum chelate compounds; titanium alkoxide compounds; organic titanium compounds; and silane coupling agents.

7. The image-forming apparatus of claim 1, wherein the metal oxide fine particles have a powder resistance of about $10^2$ to about $10^{11}$ Ωcm.

8. The image-forming apparatus of claim 1, wherein the metal oxide fine particles have a specific surface area of 10 $m^2/g$ or more.

9. The image-forming apparatus of claim 1, wherein the addition of the acceptor compound on the metal oxide fine particles is carried out by applying, on the metal oxide fine particles, a solution in which the acceptor compound is dissolved in an organic solvent.

10. An image-forming device, comprising a plurality of image forming units each having an electrophotographic photoreceptor, a charging unit, a light-exposure unit, and a development unit, a transfer unit, and a controller that controls the traveling speed of the peripheral surface of each of the electrophotographic photoreceptors and thus makes a period from charging to development variable, wherein:

the electrophotographic photoreceptor comprises an undercoat layer and a photosensitive layer; and the undercoat layer contains metal oxide fine particles with an acceptor compound added on the metal oxide fine particles in a content of about 0.01% to about 20% by weight and wherein the metal oxide fine particles with the acceptor compound added thereon are dispersed in a resin; and an image is formed by charging, light exposure, development and transfer while causing the peripheral surface of each of the electrophotographic photoreceptors to travel in a predetermined direction, wherein:

the acceptor compound is one or more compounds selected from monohydroxyanthraquinone and aminohydroxyanthraquinone.

11. The image-forming device of claim 10, wherein the controller controls the traveling speed of the peripheral surface of each of the electrophotographic photoreceptors such that operation is switchable between a plurality of control modes including a normal mode, a low-speed mode and a high-speed mode.

12. The image-forming device of claim 10, wherein the metal oxide fine particles are surface-treated with a coupling agent before addition of the acceptor compound.

13. The image-forming device of claim 10, wherein the metal oxide fine particles contain one or more kinds selected from titanium oxide, zinc oxide, tin oxide, and zirconium oxide particles.

14. The image-forming device of claim 10, wherein the charging unit is a contact-type charging device that is brought into contact with the electrophotographic photoreceptor to charge the electrophotographic photoreceptor.

15. The image-forming device of claim 14, wherein the transfer unit has an intermediate transfer member and transfers toner images formed on the peripheral surfaces of the electrophotographic photoreceptors to the intermediate transfer member and then transfers the toner images from the intermediate transfer member to an image-receiving medium.

16. The image-forming device of claim 10, wherein the metal oxide fine particles have a powder resistance of about $10^2$ to about $10^{11}$ Ωcm.

17. The image-forming device of claim 10, wherein the metal oxide fine particles have a specific surface area of 10 $m^2/g$ or more.

18. The image-forming device of claim 10, wherein the addition of the acceptor compound on the metal oxide fine particles is carried out by applying, on the metal oxide fine particles, a solution in which the acceptor compound is dissolved in an organic solvent.

19. A process cartridge that is detachable from an image-forming apparatus for forming an image by charging, light exposure, development and transfer while causing the peripheral surface of an electrophotographic photoreceptor to travel in a predetermined direction, the process cartridge comprising: an electrophotographic photoreceptor, a controller that controls the traveling speed of the peripheral surface of the electrophotographic photoreceptor and that thus makes a period from charging to development variable, and at least one selected from a charging unit, a development unit, a transfer unit and a cleaning unit, wherein:

the electrophotographic photoreceptor comprises an undercoat layer and a photosensitive layer; and the undercoat layer contains metal oxide fine particles with an acceptor compound added on the metal oxide fine particles in a content of about 0.0 1% to about 20% by weight and wherein the metal oxide fine particles with the acceptor compound added thereon are dispersed in a resin; wherein:

the acceptor compound is one or more compounds selected from monohydroxyanthraquinone and aminohydroxyanthraquinone.

20. The process cartridge of claim 19, wherein the metal oxide fine particles have a powder resistance of about $10^2$ to about $10^{11}$ Ωcm.

21. The process cartridge of claim 19, wherein the metal oxide fine particles have a specific surface area of 10 $m^2/g$ or more.

22. The process cartridge of claim 19, wherein the addition of the acceptor compound on the metal oxide fine particles is carried out by applying, on the metal oxide fine particles, a solution in which the acceptor compound is dissolved in an organic solvent.

* * * * *